US010954095B2

(12) United States Patent
Hasegawa et al.

(10) Patent No.: US 10,954,095 B2
(45) Date of Patent: Mar. 23, 2021

(54) PAPER SHEET PROCESSING DEVICE

(71) Applicant: JAPAN CASH MACHINE CO., LTD., Osaka (JP)

(72) Inventors: Makoto Hasegawa, Osaka (JP); Yoshihito Osada, Osaka (JP); Kazuya Furumachi, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 0 days.

(21) Appl. No.: 16/486,412

(22) PCT Filed: Feb. 22, 2018

(86) PCT No.: PCT/JP2018/006353
§ 371 (c)(1),
(2) Date: Aug. 15, 2019

(87) PCT Pub. No.: WO2018/168377
PCT Pub. Date: Sep. 20, 2018

(65) Prior Publication Data

US 2020/0180895 A1 Jun. 11, 2020

(30) Foreign Application Priority Data

Mar. 15, 2017 (JP) ..... JP2017-049657

(51) Int. Cl.
*B65H 31/22* (2006.01)
*B65H 39/10* (2006.01)

(52) U.S. Cl.
CPC ..... *B65H 39/10* (2013.01)

(58) Field of Classification Search
CPC ..... B65H 31/10; B65H 31/22; B65H 39/10; G07D 9/00
(Continued)

(56) References Cited

U.S. PATENT DOCUMENTS 4,790,476 A * 12/1988 Tanaka ..... E05G 1/005 232/1 D
5,219,158 A * 6/1993 Kilian ..... B65H 31/22 271/145

(Continued)

FOREIGN PATENT DOCUMENTS

JP 58-12084 A 1/1983
JP 59143832 A 8/1984

(Continued)

OTHER PUBLICATIONS

WIPO, Japanese International Search Authority, International Search Report (with English translation) and Written Opinion dated May 15, 2018 in International Patent Application No. PCT/JP2018/006353, 9 pages.

(Continued)

*Primary Examiner* — Leslie A Nicholson, III
(74) *Attorney, Agent, or Firm* — Masuvalley & Partners

(57) ABSTRACT

Provided is a paper sheet processing device in which a plurality of paper sheets stacked after processing can be easily taken out in a state where ends thereof are aligned, without binding the paper sheets. The paper sheet processing device includes a stacking unit 6 that stacks therein the paper sheets after being processed by a processing unit 4. The stacking unit 6 includes a stacking unit main body 7, and a storage box 9 that can be taken in and out of a box storage space 7*a* of the stacking unit main body 7.

3 Claims, 23 Drawing Sheets

(58) Field of Classification Search
USPC ..... 270/58.01, 58.13, 58.19, 58.28
See application file for complete search history.

(56) References Cited

U.S. PATENT DOCUMENTS

| | | | | | |
|---|---|---|---|---|---|
| 5,597,152 | A * | 1/1997 | Chinzei | B65H 1/14 | 270/39.05 |
| 5,803,227 | A * | 9/1998 | Stein | B65H 29/36 | 194/206 |
| 5,803,704 | A * | 9/1998 | Lazzarotti | B07C 1/025 | 414/218 |
| 7,988,140 | B2 * | 8/2011 | Iguchi | B65H 29/46 | 270/58.13 |
| 8,066,273 | B2 * | 11/2011 | Connell | B65H 31/10 | 271/9.08 |
| 2010/0129189 | A1 | 5/2010 | Ward | | |
| 2011/0296802 | A1 | 12/2011 | Yano et al. | | |
| 2012/0026263 | A1 * | 2/2012 | Chiwata | B65H 33/02 | 347/101 |

FOREIGN PATENT DOCUMENTS

| | | | |
|---|---|---|---|
| JP | H01-143757 | U | 10/1989 |
| JP | 5129339 | B2 | 1/2013 |
| JP | 5438093 | B2 | 12/2013 |
| JP | 2015-005023 | A | 1/2015 |
| JP | 2016-15003 | A | 1/2016 |
| WO | WO2009/090758 | A1 | 7/2009 |

OTHER PUBLICATIONS

The extended European Search Report dated Sep. 29, 2020, issued in European Application No. EP18757830.5, 8 pages.

* cited by examiner

PAPER SHEET PROCESSING DEVICE

RELATED APPLICATIONS

This application is the U.S. National Phase of and claims priority to International Patent Application No. PCT/JP2018/006353, International Filing Date Feb. 22, 2018, entitled Paper Sheet Processing Device; which claims benefit of Japanese Application No. 2017-049657 filed Mar. 15, 2017; both of which are incorporated herein by reference in their entireties.

FIELD

The present invention relates to a paper sheet processing device.

BACKGROUND

Conventionally, various types of paper sheet processing devices that perform processing such as discrimination of authenticity and denomination with respect to paper sheets such as banknotes and checks have been proposed. Such a paper sheet processing device includes, as described in Patent Literature 1, an inserting portion into which a bundle of banknotes consisting of a large number of banknotes in a mixed state are collectively inserted to process a large number of banknotes in a short time, a processing unit that discriminates authenticity and denomination of banknotes while transporting banknotes of the bundle of banknotes one by one, and at least one stacker unit in which banknotes processed by the processing unit are stacked by denomination or the like. The bundle of banknotes stacked in a storage of the respective stacker units are taken out sequentially by hand by an operator.

Further, as described in Patent Literature 2, there has also been proposed a paper sheet processing device including a binding mechanism that can band banknotes of a specific denomination stacked in each stacker unit in a unit of a specified number of banknotes.

CITATION LIST

Patent Literatures

Patent Literature 1: Japanese Patent No. 5129339
Patent Literature 2: Japanese Patent No. 5438093

SUMMARY

Technical Problem

In the paper sheet processing device described in Patent Literature 1 described above, when a plurality of banknotes after processing such as counting are sequentially loaded into the storage of the stacker unit from a slot on an upper side of the storage, drop positions of the banknotes tend to vary by the time when the banknotes reaches a bottom wall of the storage. Therefore, it is difficult to stack the banknotes in a state where ends of the banknotes are aligned tidily.

Further, there is a risk that a plurality of bundles of banknotes collapse when an operator holds by hand and takes out the bundles of banknotes stacked in the storage.

As described above, the bundles of banknotes stacked in the storage are in a state where the ends of the banknotes are not aligned tidily at the time of being stacked or taken out. Therefore, when the bundles of banknotes are set to a machine of postprocessing such as an automatic teller machine (ATM) or the like, the operator needs to align the ends on both front and rear sides for respective bundles of banknotes, and it becomes a burden on the operators.

Further, in the paper sheet processing device described in Patent Literature 2, the binding mechanism for binding the stacked banknotes is required separately from the stacker unit. Therefore, the paper sheet processing device becomes large and expensive, which is not preferable from commercial and practical points of view.

The present invention has been achieved in view of the above problems, and an object of the present invention is to provide a paper sheet processing device that can easily take out a plurality of paper sheets stacked after processing in a state where ends thereof are aligned, without binding the paper sheets.

Solution to Problem

In order to solve the above problem, a paper sheet processing device according to the present invention is a paper sheet processing device that processes a plurality of paper sheets and stacks the processed paper sheets, the paper sheet processing device comprising a processing unit that processes the paper sheets and at least one stacking unit that stacks therein the paper sheets after being processed by the processing unit, wherein the stacking unit includes a stacking unit main body having a box storage space, and a storage box having a size capable of putting in and out the storage box from the box storage space, and having an opening formed in an upper part of the storage box, through which the paper sheets can pass, and a paper-sheet storage space for storing the stacked paper sheets.

According to this configuration, the paper sheets after being processed by the processing unit are stacked in the storage box in the stacking unit. Specifically, in the stacking unit, in a state where the storage box is set in the box storage space of the stacking unit main body, the paper sheets are stored with scatter thereof being suppressed inside the paper-sheet storage space of the storage box, and the paper sheets can be stacked in a state where the ends thereof are aligned tidily. It is possible to take out the processed paper sheets to outside from the stacking unit main body in each storage box in a state where the ends thereof are aligned tidily in the storage box, without binding the processed paper sheets. Therefore, since an operator does not directly touch the stacked paper sheets, there is no risk of collapse at the time of taking out the paper sheets from the stacking unit main body.

It is preferable that the stacking unit further includes a placing portion having an upper surface that is wide enough to place the paper sheets thereon and arranged movably in a vertical direction inside the storage box, and a placing-portion moving unit that moves the placing portion at least upward, in a state where the storage box is stored in the box storage space.

According to this configuration, the placing portion capable of moving vertically is arranged inside the storage box. It is possible to reduce a distance from the opening in the upper part of the storage box to the placing portion by moving the placing portion beforehand to a predetermined upper position by the placing-portion moving unit, when the paper sheets are stored in the storage box. Accordingly, when the paper sheets are loaded into the paper-sheet storage space of the storage box from the opening, the paper sheets are hardly scattered, and can be stacked in a state where the ends thereof are aligned tidily. As the paper sheets are stacked on the placing portion, the placing portion descends due to the own weight of the paper sheets or a driving force of the placing-portion moving unit, thereby enabling to stack the paper sheets in the storage box in a state where the respective ends are aligned more tidily.

It is preferable that the placing-portion moving unit has a moving member capable of moving vertically, and the placing portion can be attached to or detached from the moving member.

According to this configuration, since the placing portion can be attached to or detached from the moving member that can move vertically, the placing portion can be in a state of being vertically movable by the moving member and in a state of being positioned in the storage box and being away from the moving member.

It is preferable that the paper sheet processing device further comprises a coupling unit that detachably couples the placing portion and the moving member with each other, wherein the coupling unit includes at least one magnet, and the magnet is provided in any one or both of the placing portion and the moving member, and the magnet is arranged to detachably couple the placing portion and the moving member with each other in a state where the storage box is stored in the box storage space, and release the coupling in a state where the storage box is out of the box storage space.

According to this configuration, an operator can detachably couple the placing portion in the storage box with the moving member in the placing-portion moving unit by the magnet, by inserting the storage box into the box storage space of the stacking unit main body. Therefore, the operator can easily perform an operation to set the storage box in the box storage space of the stacking unit main body. In a state where the placing portion and the moving member are coupled with each other, the moving member is moved upward and then the placing portion can be raised and arranged close to the opening in the upper part of the storage box.

On the other hand, at the time of taking out the paper sheets stored in the storage box, the operator takes out the storage box from the box storage space of the stacking unit main body, thereby enabling to release the coupling between the placing portion and the moving member by the magnet. At this time, the placing portion released from the coupling with the moving member descends inside the storage box, while maintaining a state where the paper sheets are placed thereon. Accordingly, there is no risk that the paper sheets drop out of the opening in the upper part of the storage box, and the operator can easily perform an operation of taking out the storage box in which the paper sheets are stored from the stacking unit main body.

It is preferable that a slit for magnet coupling, which penetrates a side wall and extends vertically, is formed in the side wall of the storage box, and the magnet couples the placing portion and the moving member with each other through the slit.

According to this configuration, the magnet can strongly couple the placing portion in the storage box with the moving member of the placing-portion moving unit outside the storage box, through the slit formed in the side wall of the storage box. Further, since the magnet moves vertically along the slit, following the vertical movement of the moving member, even if the moving member moves vertically, contact of the magnet with the side wall of the storage box can be avoided. Therefore, there is no risk that the coupling between the moving member and the placing portion by the magnet is released when the moving member and the placing portion move vertically in the coupled state.

It is also allowable that the moving member includes a support portion having a shape capable of supporting the placing portion from below in a state capable of being detached from the placing portion, the storage box has a bottom wall and a side wall standing upward from an edge of the bottom wall, the side wall has a first slit for passage of the support portion, which penetrates the side wall and extends vertically, through which the support portion can pass, and the bottom wall has a bottom opening communicating with the first slit, through which the support portion can pass.

According to this configuration, in a state where the storage box is stored in the box storage space of the stacking unit main body, the support portion of the moving member is inserted into the storage box through the bottom opening in the bottom wall and the first slit in the side wall of the storage box by raising the moving member of the placing-portion moving unit, and the support portion can be raised in the storage box along the first slit.

Accordingly, the placing portion in the storage box can be supported from below by the support portion and can be moved vertically together with the placing portion.

Meanwhile, when the storage box is to be taken out from the box storage space, the support portion can be detached to outside of the storage box from the bottom opening in the bottom wall of the storage box if the support portion is lowered manually or automatically. Accordingly, the storage box can be taken out from the stacking unit main body, while avoiding an interference with the support portion. Further, the placing portion can be lowered and returned to a predetermined lower position, following the descent of the support portion. Therefore, when the storage box is taken out from the stacking unit main body, there is no risk that the paper sheets drop out of the opening in the upper part of the storage box. As described above, since the interference between the storage box and the support portion and outflow of paper sheets from the opening can be avoided, the operator can easily perform the operation of taking out the storage box in which the paper sheets are stored from the stacking unit main body.

It is preferable that the placing-portion moving unit further includes an energizing member that provides an upward energizing force to the moving member.

According to this configuration, in a state where the storage box is stored in the box storage space of the stacking unit main body, the energizing member can provide the upward energizing force to the placing portion via the moving member. Accordingly, the placing portion can be raised and arranged close to the opening in the upper part of the storage box by the energizing force of the energizing member. Therefore, another driving source for raising the placing portion is not required. Further, as paper sheets are stacked on the placing portion, the placing portion gradually descends against the energizing force of the energizing member due to the weight of the stacked paper sheets, so that the paper sheets can be stacked on the placing portion while the respective ends are aligned. Accordingly, another driving source is not required for lowering the placing portion as the paper sheets are stacked on the placing portion. Therefore, a driving source for vertically moving the placing portion can be omitted or simplified.

It is preferable that the placing-portion moving unit further includes an energizing member that provides an upward energizing force to the moving member, the side wall has a second slit communicating with the bottom opening and penetrating the side wall, and the support portion can be operated downward by projecting to outside of the storage box through the second slit, in a state where the support portion is inserted into the storage box.

According to this configuration, when the moving member is lowered, the moving member can be lowered against the energizing force of the energizing member by pressing the support portion of the moving member by a finger. Therefore, a driving source for lowering the moving member is not required. Further, since the moving member can be raised by the energizing force of the energizing member, a driving force for moving the moving member is not required other than the energizing member, thereby enabling to simplify the configuration of the placing-portion moving unit.

According to this configuration, the support portion projects to outside of the storage box through the second slit, even in the state of being inserted into the storage box. Therefore, by pressing the support portion downward by a finger, it is possible to lower both the support portion and the placing portion against the energizing force of the energizing member, while maintaining a state where the support portion supports the placing portion from below in the storage box.

It is preferable that the storage box has a bottom wall vertically movable and a side wall vertically extendable with a vertical movement of the bottom wall, and further includes a support portion that supports an upper end of the side wall at a predetermined height inside of the box storage space.

According to this configuration, by vertically moving the bottom wall of the storage box, the storage box can be deformed between a vertically extended state and a folded state. If the folded storage box is inserted into the box storage space, the upper end of the side wall of the storage box is supported by the support portion so as to be at the predetermined height, and the bottom wall is arranged at a predetermined upper position by the driving force of the placing-portion moving unit or an elastic force of the side wall itself, the storage box in the folded state can be attached to an upper position in the box storage space. Accordingly, when paper sheets are loaded into the storage box from the opening in the upper part of the storage box, the paper sheets are hardly scattered, and can be stacked in a state where the ends thereof are aligned tidily. As the paper sheets are stacked inside the storage box, the bottom wall descends due to the own weight of the paper sheets or the driving force of the placing-portion moving unit, thereby enabling to stack the paper sheets in the storage box in a state where the respective ends are aligned more tidily, while the side wall is extended vertically to cover the circumference of the paper sheets. Further, when the paper sheets are not stored in the storage box, the empty storage box in the folded state can be easily stored and transported.

Advantageous Effects of Invention

As described above, according to the paper sheet processing device of the present invention, it is possible to easily take out a plurality of paper sheets stacked after processing in a state where ends thereof are aligned, without binding the paper sheets.

DESCRIPTION OF EMBODIMENTS

Embodiments of a paper sheet processing device according to the present invention will be described below in detail with reference to the accompanying drawings. In the following embodiments, as an example of the paper sheet processing device according to the present invention, a banknote processing device that processes banknotes is described.

Figure 1:
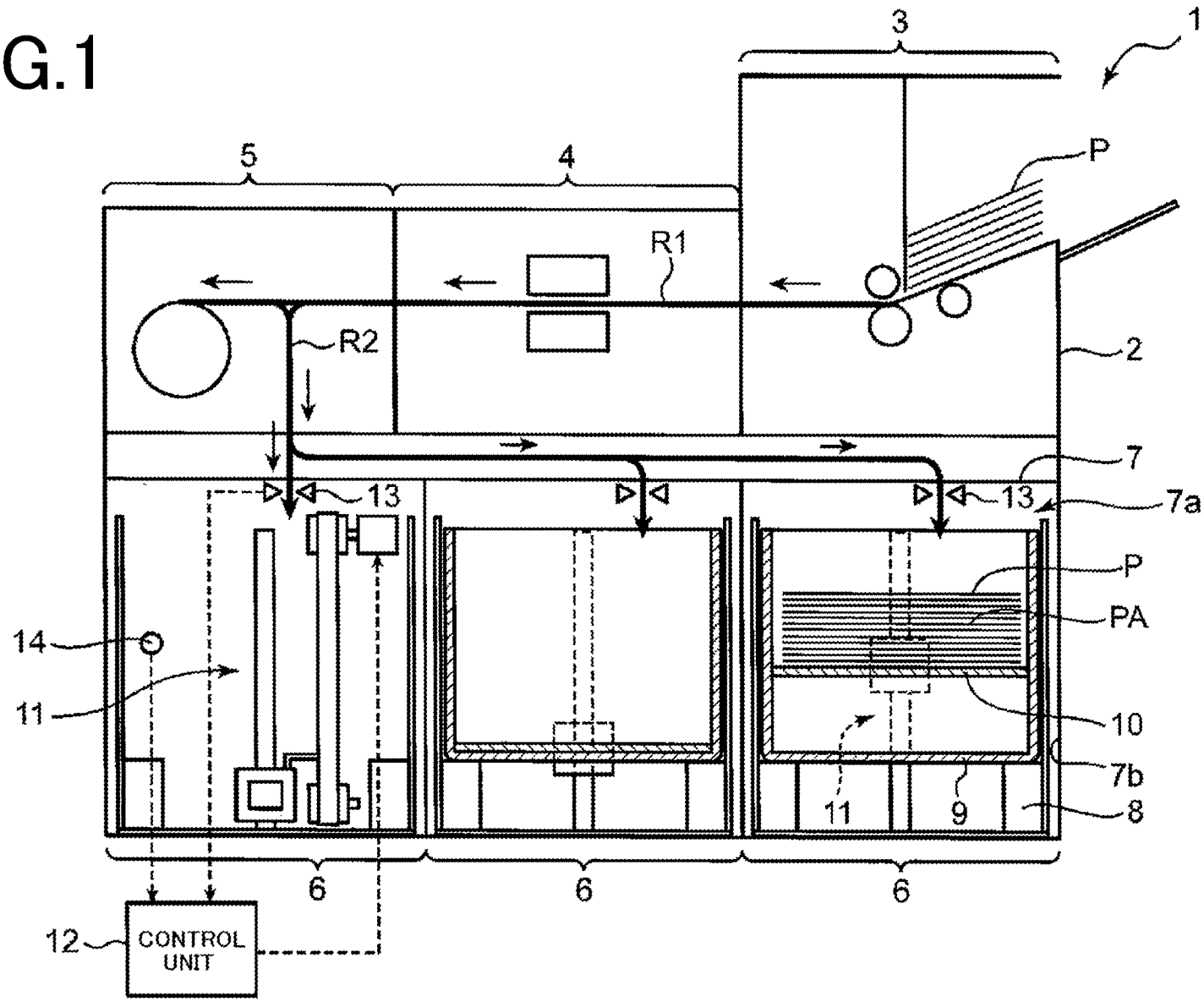
FIG. 1 is a cross-sectional explanatory diagram illustrating a configuration of a paper sheet processing device according to an embodiment of the present invention.

As illustrated in FIG. 1, a banknote processing device 1 according to the present embodiment performs processing such as discrimination of authenticity and denomination of a plurality of banknotes P and stacks the processed banknotes P to form stacked banknotes PA.

The banknote processing device 1 includes a device main body 2, a deposit unit 3, a processing unit 4 being a processing unit that performs discrimination of authenticity and denomination, a temporary storage unit 5 that temporarily holds the processed banknotes P, a plurality of stacking units 6 being stacking units that stack the banknotes P according to conditions such as denomination, a control unit 12, a banknote detection sensor 13 that detects the banknotes P fed to the respective stacking units 6, and a box detection sensor 14 that detects the presence of a storage box 9 in each stacking unit 6.

In the banknote processing device 1, the banknotes P collectively inserted into the deposit unit 3 are transported by a transport mechanism (not illustrated) along transport routes R1 and R2 one by one. When the banknotes P are fed from the deposit unit 3 to the processing unit 4 along the transport route R1, the processing unit 4 performs processing such as discrimination of authenticity and denomination of the banknotes P. The processed banknotes P are temporarily held in the temporary storage unit 5 and fed to the transport route R2, or directly fed to the transport route R2 without being held in the temporary storage unit 5. Thereafter, the banknotes P are classified and fed to any one of the plurality of stacking units 6 along the transport route R2 based on a discrimination result of the authenticity and denomination in the processing unit 4, and stacked in the storage box 9 in the stacking unit 6. The banknotes P can be classified according to old and new categories. In this case, new banknotes are reused in other devices (for example, an automatic teller machine (ATM)) outside the banknote processing device 1, and old banknotes are recovered.

The stacking unit 6 stacks therein the banknotes P processed by the processing unit 4 to form the stacked banknotes PA. It suffices that the banknote processing device 1 includes at least one stacking unit 6, and the number of stacking units 6 is not limited in the present invention.

The stacking unit 6 includes a stacking unit main body 7, a box guide 8, the storage box 9, a banknote stacking table 10, and a table moving unit 11.

Figure 2:
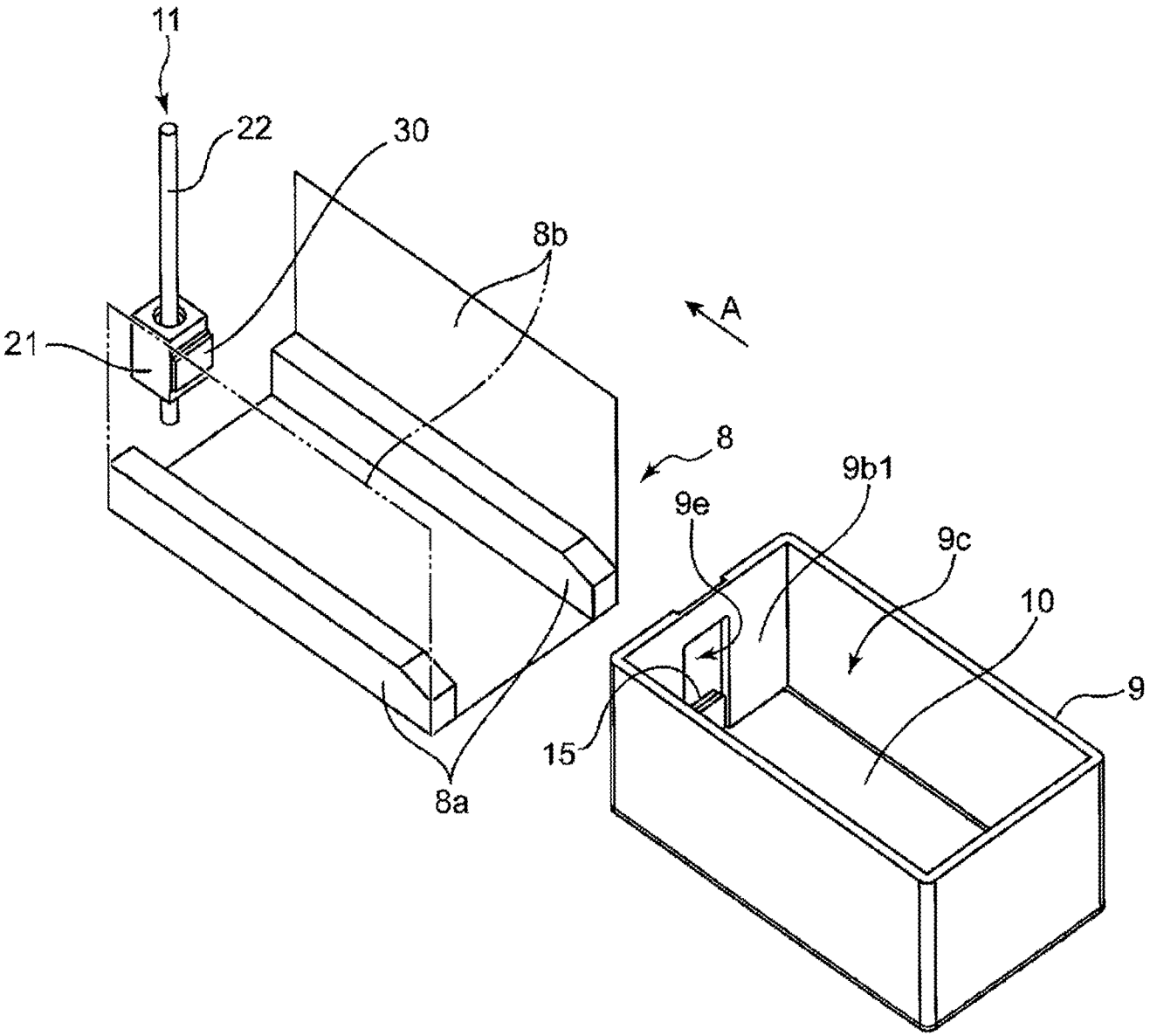
FIG. 2 is a perspective explanatory diagram illustrating an arrangement of a storage box, a box guide, and a table moving unit in FIG. 1.

The stacking unit main body 7 includes a box storage space 7*a* having a cubic capacity capable of storing the storage box 9. The storage box 9 can be taken in and out of the box storage space 7*a* through an opening 7*b* formed on a front surface side of the stacking unit main body 7. The box guide 8 that guides the storage box 9 at the time of taking in and out the storage box 9 is attached to the box storage space 7*a*. The box guide 8 includes, for example, as illustrated in FIG. 2, a pair of support blocks 8*a* that support the storage box 9 from below, and a pair of guide plates 8*b* that support the storage box 9 from both the right and left sides.

Figure 3:
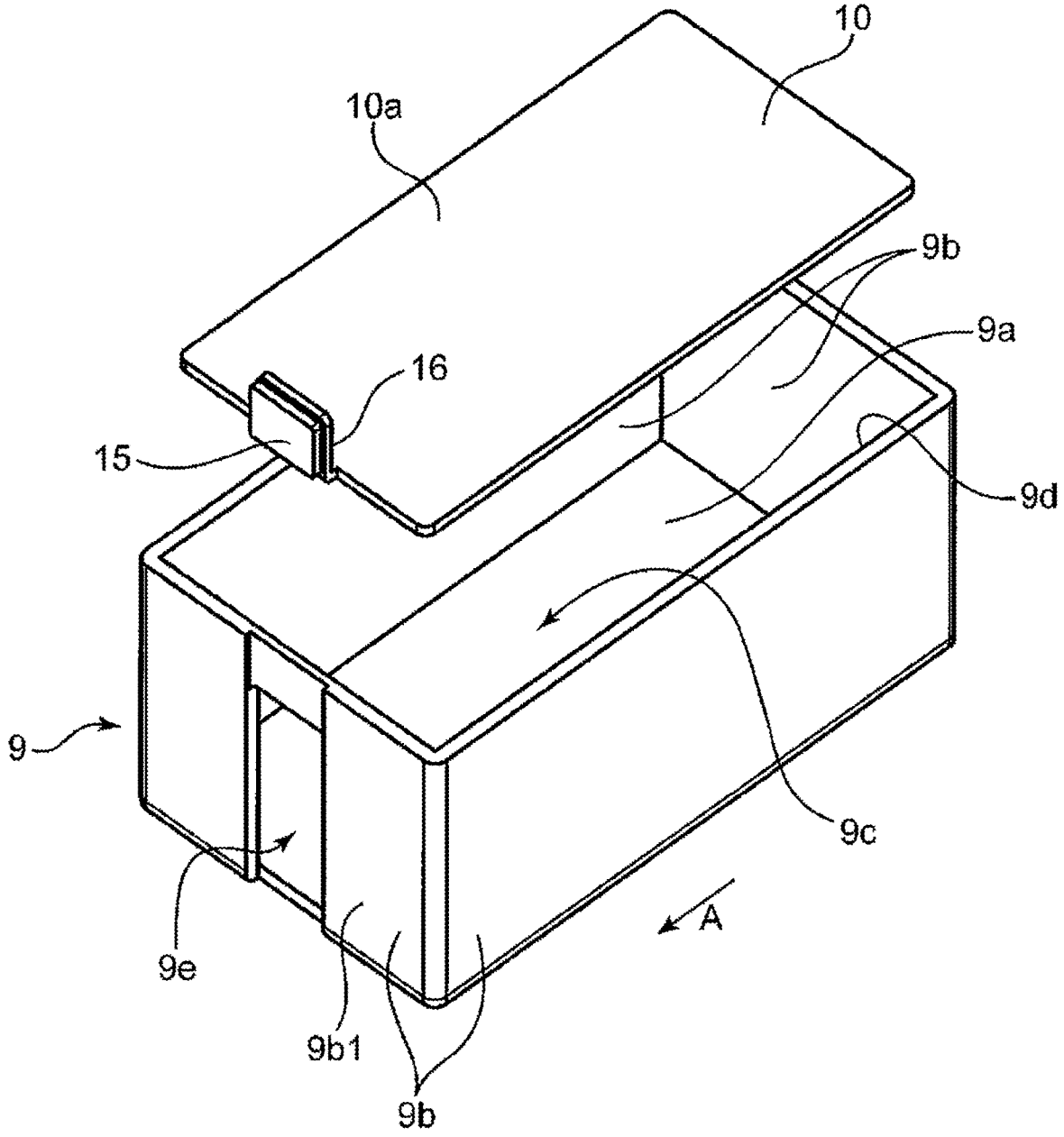
FIG. 3 is a perspective view of the storage box and a banknote stacking table in FIG. 1.

As illustrated in FIG. 3, the storage box 9 is a rectangular parallelepiped hollow box having an opening 9*d* at an upper end, and has a bottom area adapted to the size of the banknote P. Specifically, the storage box 9 has a rectangular bottom wall 9*a*, and four side walls 9*b* standing upward from four edges of the bottom wall 9*a*. The bottom wall 9*a* and the four side walls 9*b* form a rectangular parallelepiped banknote storage space 9*c*. The storage box 9 has external dimensions capable of being taken in and out of the box storage space 7*a*. The opening 9*d* formed at the upper end of the storage box 9 has an opening area capable of passing the banknotes P therethrough. The banknote storage space 9*c* has a cubic capacity capable of storing the stacked banknotes PA, which are a plurality of banknotes stacked vertically. Since the banknote storage space 9*c* inside the storage box 9 is smaller than the box storage space 7*a*, banknotes P loaded into the banknote storage space 9*c* are hardly scattered as compared with a case where the banknotes P are loaded into the box storage space 7*a*. Therefore, the banknotes P can be stacked in a state of being aligned tidily inside the banknote storage space 9*c*.

A slit 9*e* that penetrates a side wall 9*b*1 of the four side walls 9*b* and extends vertically is formed in the side wall 9*b*1, which is a front side wall in an insertion direction A of inserting the storage box 9 into the box storage space 7*a*. The slit 9*e* is for coupling a magnet 15 fixed to the banknote stacking table 10 described later with a magnet 30 on the side of a linear bush 21.

The storage box 9 needs only to be able to store and transfer the stacked banknotes PA, and is formed by a material, for example, resin or a metal thin plate. Further, it is preferable that the storage box 9 has a shape and strength with which the storage box 9 can be stacked, to facilitate storage and transport of the stacked banknotes PA.

The opening 9*d* of the storage box 9 needs only to be formed in the upper part of the storage box 9, and is not limited to be formed at the upper end of the storage box 9. For example, a slit opening can be formed in the side wall 9*b* so long as it is formed in the upper part of the storage box 9.

The banknote stacking table 10 is, as illustrated in FIG. 3, a rectangular plate member and has an upper surface 10*a* that is wide enough to place the banknotes P thereon. The banknote stacking table 10 is arranged to be vertically movable inside the storage box 9. The banknote stacking table 10 is made of resin or a metal thin plate. In the present embodiment, the banknote stacking table 10 being a rectangular plate member is described as an example of the placing portion of the present invention. However, the placing portion can have other shapes, so long as it has an upper surface capable of placing the banknotes P thereon and moving vertically inside the storage box 9.

Figure 4:
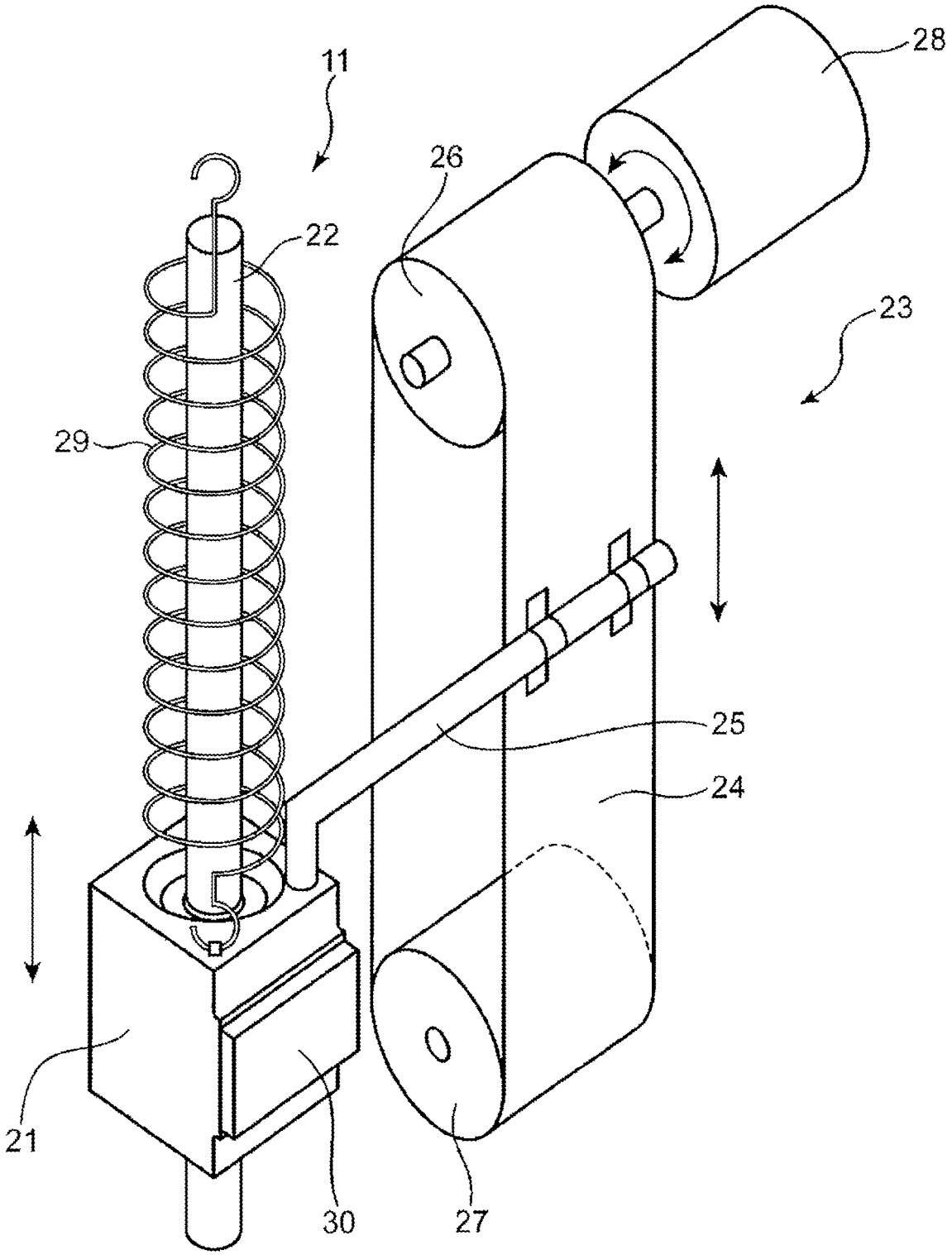
FIG. 4 is a perspective view of the table moving unit in FIG. 1.

As illustrated in FIGS. 1 to 2 and FIG. 4, the table moving unit 11 has a configuration of moving the banknote stacking table 10 at least upward in a state where the storage box 9 is stored in the box storage space 7*a*. The table moving unit 11 corresponds to a placing-portion moving unit of the claims. The table moving unit 11 is arranged on the front side of the box guide 8, in the insertion direction A of inserting the storage box 9 into the box storage space 7*a*.

Specifically, the table moving unit 11 includes the linear bush 21 configuring a moving member capable of moving vertically, a guide rod 22 for guiding the linear bush 21 in the vertical direction, a drive mechanism 23 that moves the linear bush 21 in the vertical direction, and an extension coil spring 29 being an energizing member that provides an upward energizing force to the linear bush 21.

The guide rod 22 is fixed to a bottom surface or the like of the box storage space 7*a* of the stacking unit main body 7 in a state standing up to extend vertically. The linear bush 21 has a through hole penetrating in the vertical direction, and is a member having, for example, a substantially rectangular parallelepiped shape. The linear bush 21 can move vertically, while being guided by the guide rod 22, by inserting the guide rod 22 into the through hole.

The drive mechanism 23 can have any configuration so long as it has a function of vertically moving the linear bush 21. The drive mechanism 23, for example, illustrated in FIG. 4 includes an endless belt 24 having an endless shape circularly closed, a coupling rod 25 that couples an outer periphery of the endless belt 24 with the linear bush 21, a drive pulley 26 arranged so that a central shaft extends horizontally and a driven pulley 27, and a motor 28 capable of rotating the drive pulley 26 both in a forward direction and in a reverse direction. The drive pulley 26 and the driven pulley 27 are arranged away from each other in the vertical direction so as to be lined up parallel to the guide rod 22. The endless belt 24 is wound around the drive pulley 26 and the driven pulley 27 respectively and is installed to extend parallel to the guide rod 22 between the pair of drive pulley 26 and driven pulley 27. The drive pulley 26 is rotated by a driving force of the motor 28 and then the endless belt 24 runs in a direction corresponding to a rotation direction of the drive pulley 26 between the drive pulley 26 and the driven pulley 27. At this time, the linear bush 21 coupled with the endless belt 24 via the coupling rod 25 can move in any direction of the vertical direction. Drive of the motor 28 of the drive mechanism 23 is controlled by the control unit 12. Specific control is described in detail in the descriptions of the operation of the stacking unit in the later stage.

As the drive mechanism 23 that vertically moves the linear bush 21, various types of drive mechanisms such as a mechanism having a linear motor that can drive linearly in the vertical direction can be adopted, other than the mechanism having the endless belt 24 described above.

The extension coil spring 29 is an energizing member that provides the upward energizing force to the liner bush 21. A lower end of the extension coil spring 29 is fixed to the linear bush 21, and an upper end thereof is fixed to the guide rod 22 or an internal wall of the stacking unit main body 7. Therefore, in a state where the linear bush 21 is not pressed down by the drive mechanism 23 described above, the linear bush 21 stands by in a state of being raised to a predetermined upper position by the energizing force of the extension coil spring 29. In the present embodiment, the extension coil spring 29 is described as an example of the energizing member of the present invention. However, the energizing member is not limited thereto. Any energizing member that can provide the upper energizing force to the linear bush 21 constituting the moving member is included in the energizing member of the present invention. As another energizing member of the present invention, for example, an elastic member such as rubber or an air spring can be used.

Further, the banknote processing device 1 according to the present embodiment includes a coupling unit that can detachably couple the banknote stacking table 10 with the linear bush 21 constituting the moving member. The coupling unit is configured by, as illustrated in FIGS. 2 to 4, the magnet 15 on the side of the banknote stacking table 10 and the magnet 30 on the side of the linear bush 21.

Figure 12:
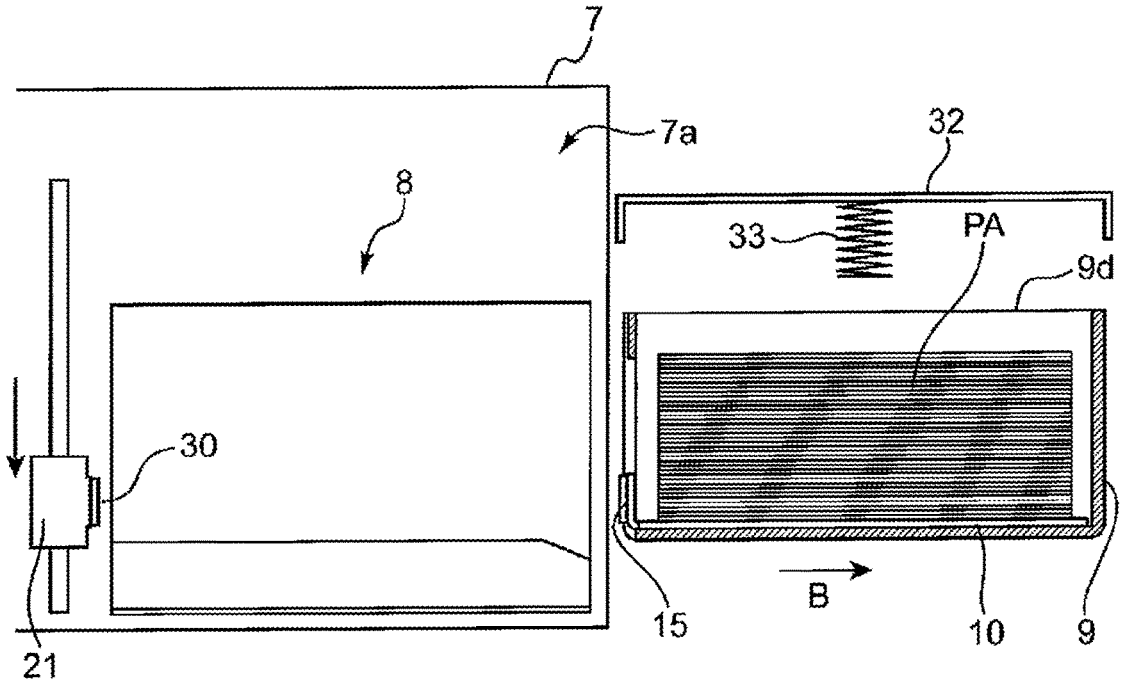
FIG. 12 is a cross-sectional explanatory diagram illustrating a state where a storage box in FIG. 11 is completely pulled out from a box guide and taken out to outside of the box storage space.

These magnets 15 and 30 are arranged to couple detachably the banknote stacking table 10 with the linear bush 21 in a state where the storage box 9 is stored in the box storage space 7*a* (see FIG. 6), and release the coupling when the storage box 9 is in a state out of the box storage space 7*a* (see FIG. 12). Specifically, the magnet 15 on the side of the banknote stacking table 10 is attached, as illustrated in FIG. 3, to the front side thereof in the insertion direction A via a bracket 16. An attracting face of the magnet 15 is arranged in a standing state to face the insertion direction A. In a state where the banknote stacking table 10 are stored in the storage box 9, the magnet 15 is arranged to be exposed to outside of the storage box 9 through the slit 9*e* formed in the side wall 9*b*1 on a front side of the storage box 9 and face the insertion direction A.

On the other hand, the magnet 30 on the side of the linear bush 21 is attached to, as illustrated in FIG. 2 and FIG. 4, a side face of the linear bush 21. An attracting face of the magnet 30 is arranged in a standing state to face an opposite direction to the insertion direction A. Accordingly, in a state where the storage box 9 is stored in the box storage space 7*a*, the magnets 15 and 30 attract each other, thereby enabling to detachably couple the banknote stacking table 10 and the linear bush 21 with each other.

That is, the banknote stacking table 10 can be attached to or detached from the linear bush 21 that can move vertically. Therefore, the banknote stacking table 10 can be in a state of being vertically movable by the linear bush 21 and in a state of being positioned in the storage box 9 and being away from the linear bush 21.

It suffices to provide the magnets 15 and 30 in one of the banknote stacking table 10 and the linear bush 21, and to arrange a magnetic plate such as iron that can be attracted to the magnet 15 or 30 on the other side.

In the banknote processing device 1 configured as described above, the banknotes P are sequentially placed on the banknote stacking table 10 that moves vertically in the storage box 9 and stacked therein. Specifically, as illustrated in FIG. 5 to FIG. 12, stacking of the banknotes P is performed in the stacking unit 6 in the following procedure.

Figure 5:
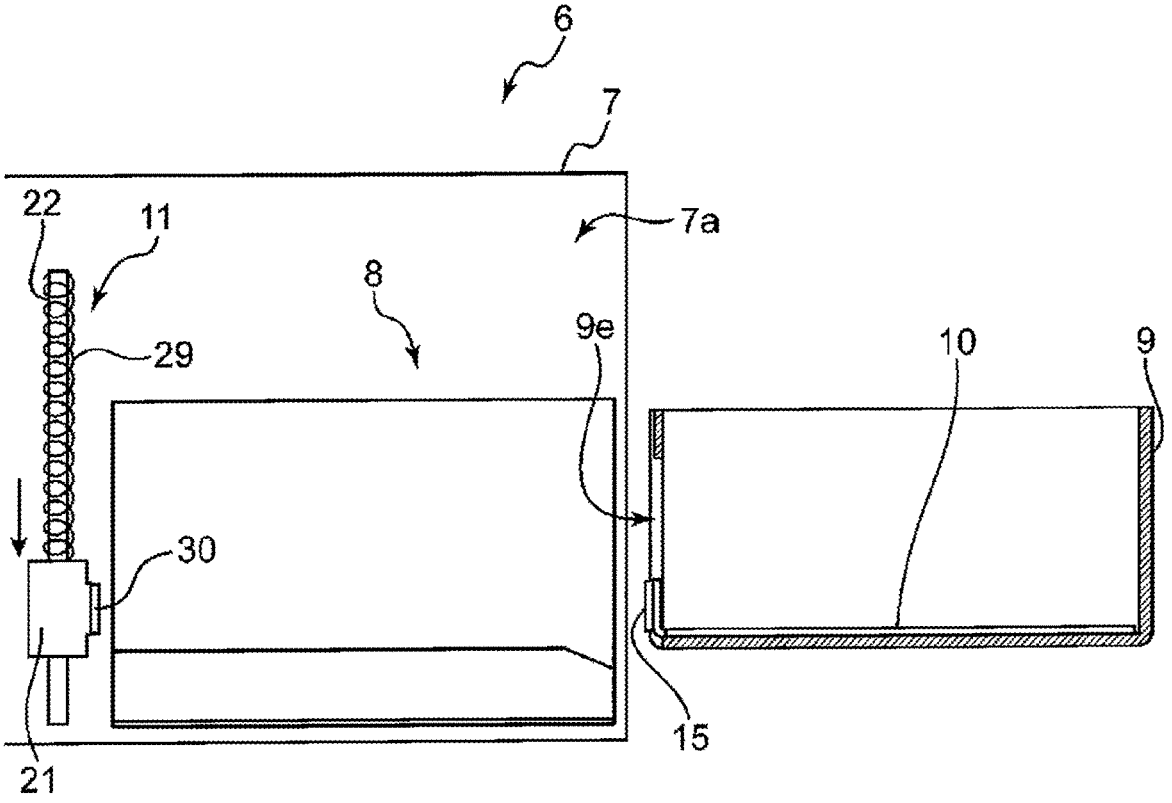
FIG. 5 is a cross-sectional explanatory diagram illustrating a process of inserting the storage box in FIG. 1 into a box storage space.

First, as illustrated in FIG. 5, in a state where the storage box 9 is not stored in the box storage space 7*a* of the stacking unit main body 7 of the stacking unit 6, the linear bush 21 is lowered to a predetermined lower position by the drive mechanism 23 to stand by. Specifically, when the box detection sensor 14 (see FIG. 1) of each stacking unit 6 does not detect the storage box 9 in an operated state of the banknote processing device 1, the control unit 12 (see FIG. 1) controls the drive of the motor 28 of the drive mechanism 23 (see FIG. 4) so that the linear bush 21 is lowered to the predetermined lower position. At this time, the extension coil spring 29 is extended as the linear bush 21 is lowered by the drive mechanism 23, thereby accumulating an elastic energy in the extension coil spring 29.

Figure 6:
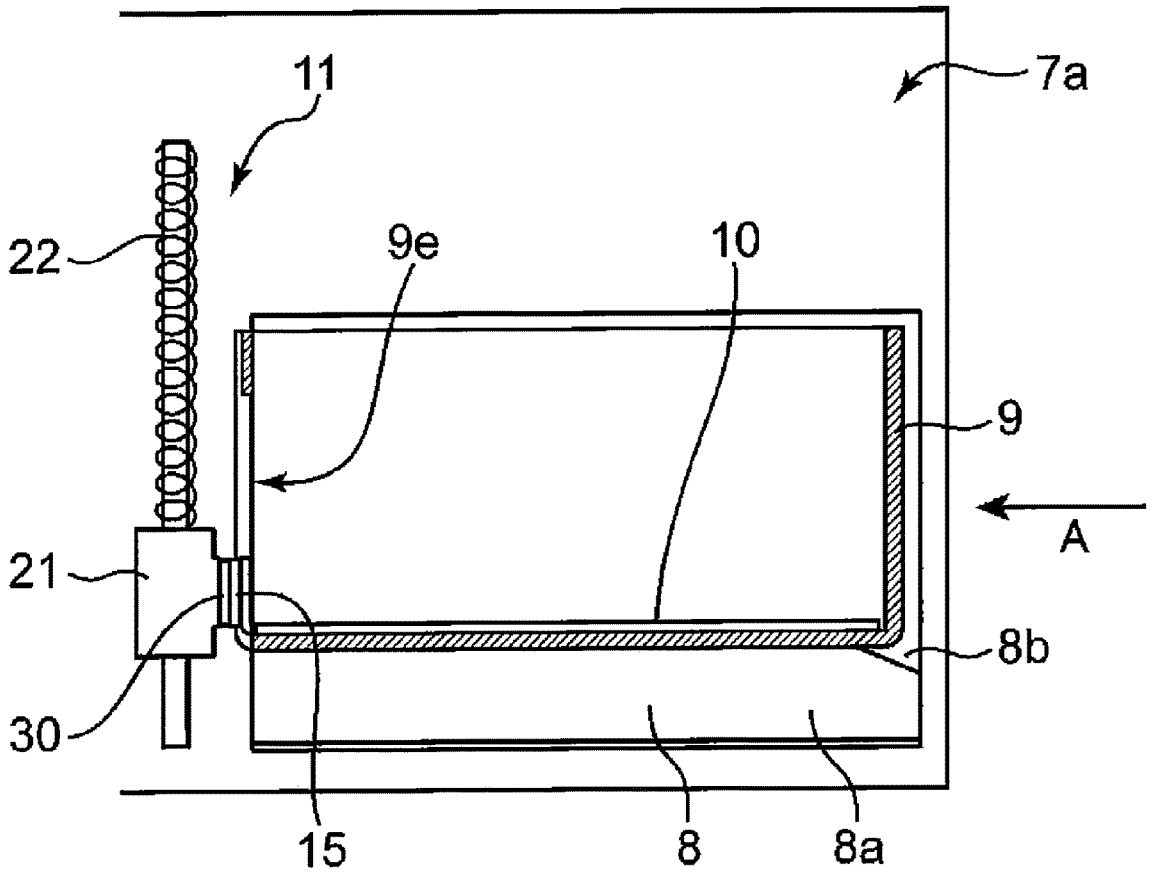
FIG. 6 is a cross-sectional explanatory diagram illustrating a state where a magnet on the side of a banknote stacking table and a magnet on the side of a linear bush in FIG. 5 attract.

In a stand-by state in FIG. 5, as illustrated in FIG. 6, the storage box 9 is pushed in the insertion direction A by an operator and inserted into the box guide 8 in the box storage space 7*a*. At this time, the magnet 15 fixed to the banknote stacking table 10 inside the storage box 9 attracts the magnet 30 fixed to the linear bush 21 through the slit 9*e* of the storage box 9. Accordingly, the banknote stacking table 10 and the linear bush 21 are detachably coupled with each other.

Figure 7:
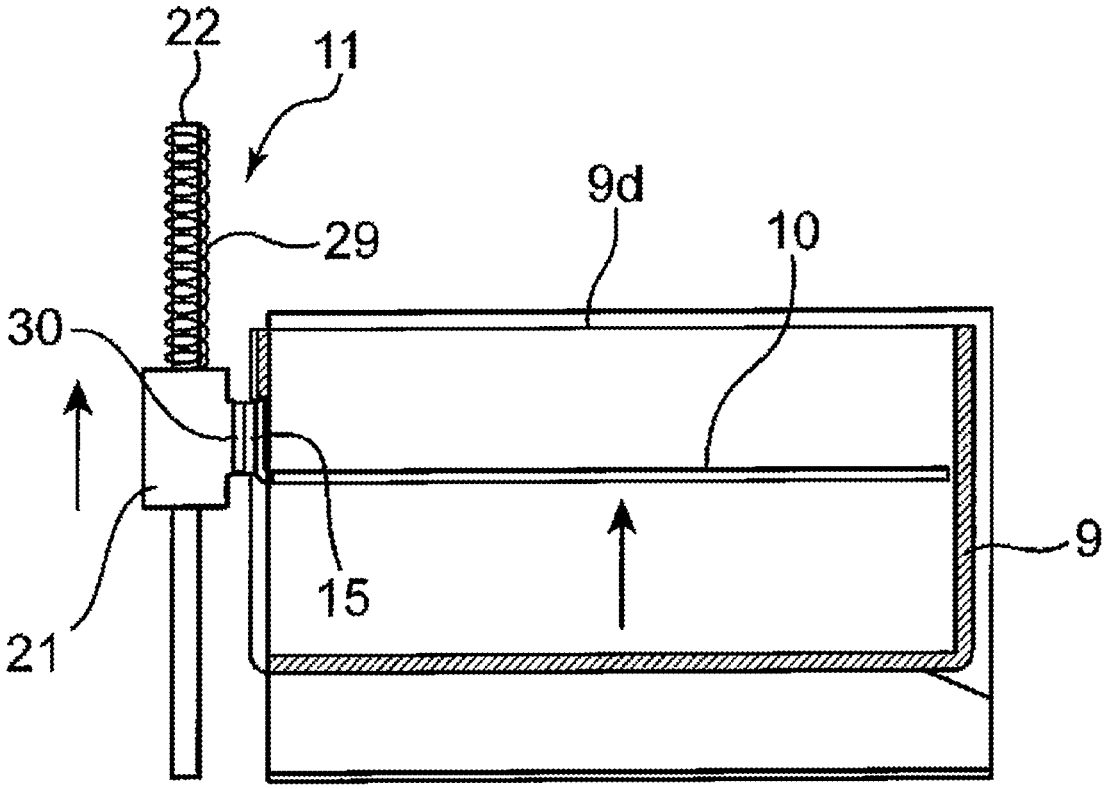
FIG. 7 is a cross-sectional explanatory diagram illustrating an operation of raising the banknote stacking table and the linear bush in FIG. 5 in a state of being connected with each other.

Thereafter, as illustrated in FIG. 7, the banknote stacking table 10 and the linear bush 21 are raised to a predetermined upper position. Specifically, the control unit 12 executes control to stop the drive of the motor 28 of the drive mechanism 23, so that the drive pulley 26 becomes a state capable of idling, and the banknote stacking table 10 and the linear bush 21 are raised to the predetermined upper position by a recovering force of the extension coil spring 29, so that the banknotes P are in a state capable of stacking. At this time, the banknote stacking table 10 is arranged at a position close to the opening 9*d* at the upper end of the storage box 9. If there is no extension coil spring 29, the banknote stacking table 10 and the linear bush 21 can be raised to the predetermined upper position by driving the motor 28 of the drive mechanism 23.

Figure 8:
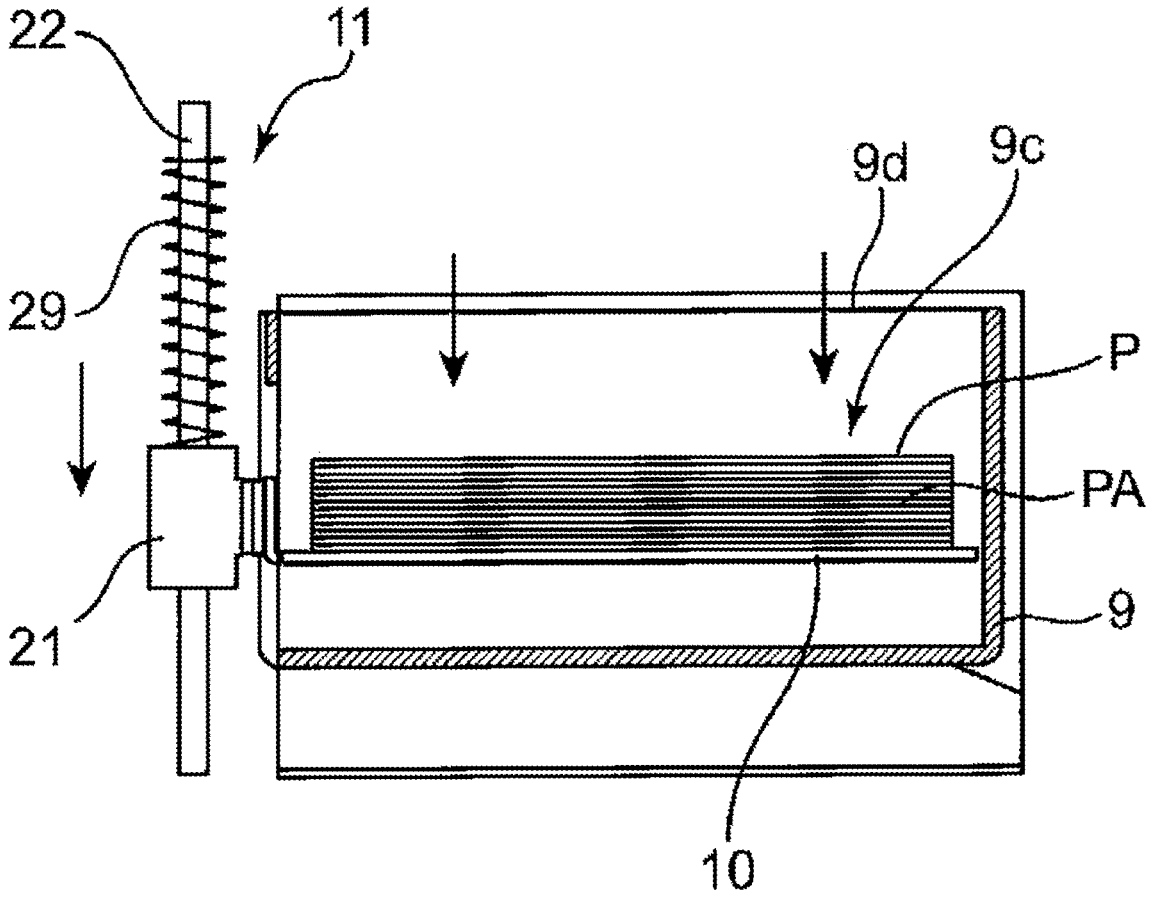
FIG. 8 is a cross-sectional explanatory diagram illustrating a state where the banknote stacking table and the linear bush in FIG. 5 are lowered as banknotes are stacked on the banknote stacking table.

The banknotes P fed to the stacking unit 6 after being processed by the processing unit 4 in FIG. 1 are sequentially loaded into the banknote storage space 9*c* from the opening 9*d* at the upper end of the storage box 9, as illustrated in FIG. 8, and stacked on the banknote stacking table 10 to form the stacked banknotes PA. At this time, as the weight of the stacked banknotes PA increases, the banknote stacking table 10 gradually descends against the upward energizing force of the extension coil spring 29. If there is no extension coil spring 29, the banknote stacking table 10 and the linear bush 21 can be lowered gradually by driving the motor 28 of the drive mechanism 23. In this case, a lowered amount of the banknote stacking table 10 and the linear bush 21 can be controlled by the control unit 12 based on the number of banknotes P fed to the stacking unit 6, which is detected by the banknote detection sensor 13.

Figure 9:
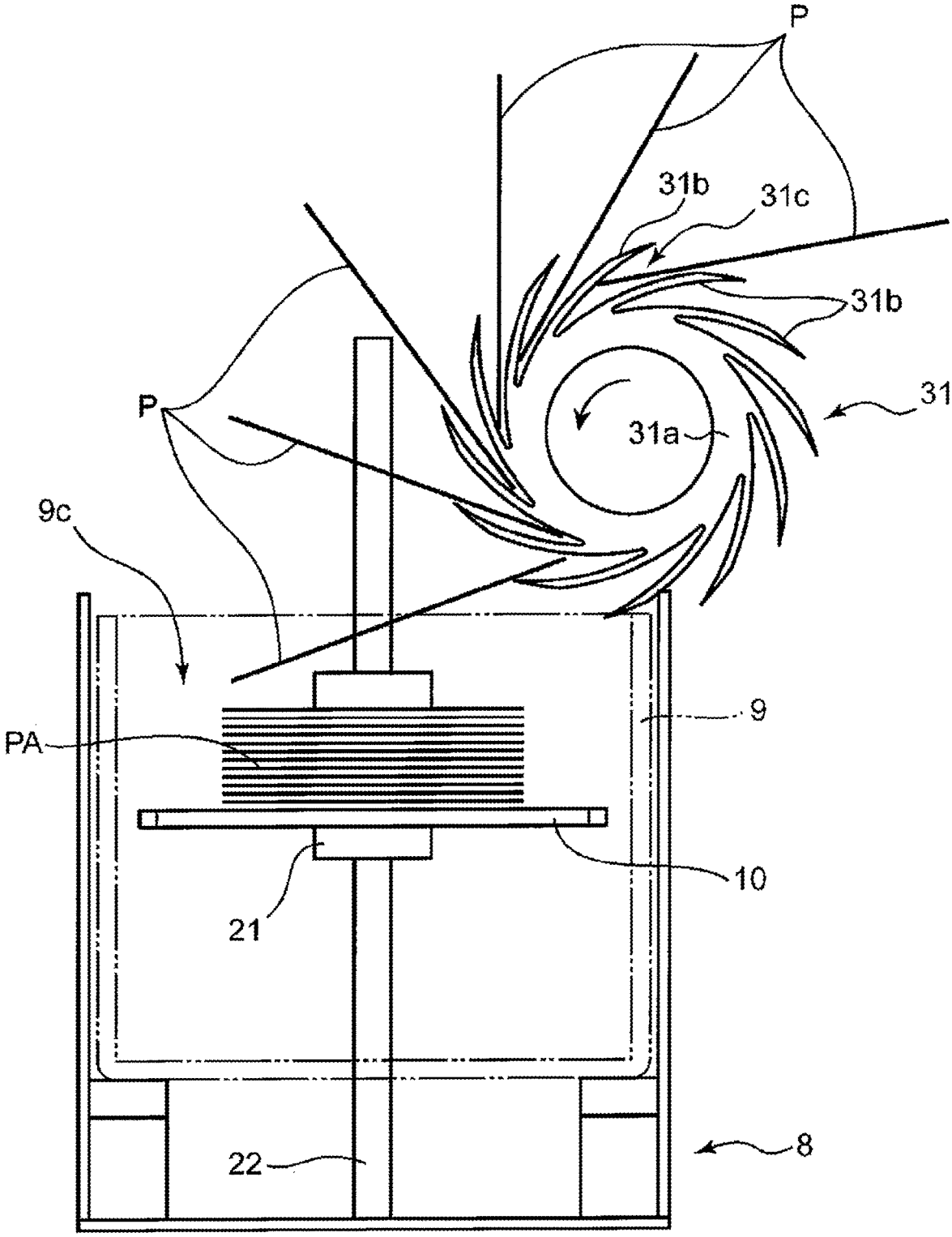
FIG. 9 is a cross-sectional explanatory diagram illustrating a state where banknotes are fed to the banknote stacking table by using an impeller in a configuration where the impeller is provided above a storage box in FIG. 8 as a modification of the present invention.

In order to sequentially load the banknotes P into the storage box 9 smoothly, an impeller 31 as illustrated in FIG. 9 can be provided in the stacking unit 6. The impeller 31 includes a cylindrical main body 31*a*, and a plurality of impeller blades 31*b* extending on a cylindrical outer periphery of the main body 31*a* in a tangent direction of the outer periphery. When the banknotes P are fed into the stacking unit 6, the impeller 31 is rotated in a counterclockwise direction by driving a motor (not illustrated), thereby rotating and moving the banknotes P sequentially by putting one banknote P in a gap 31*c* between the adjacent two impeller blades 31*b*. Accordingly, the banknotes P can be sequentially loaded into the storage box 9 one by one smoothly.

Figure 10:
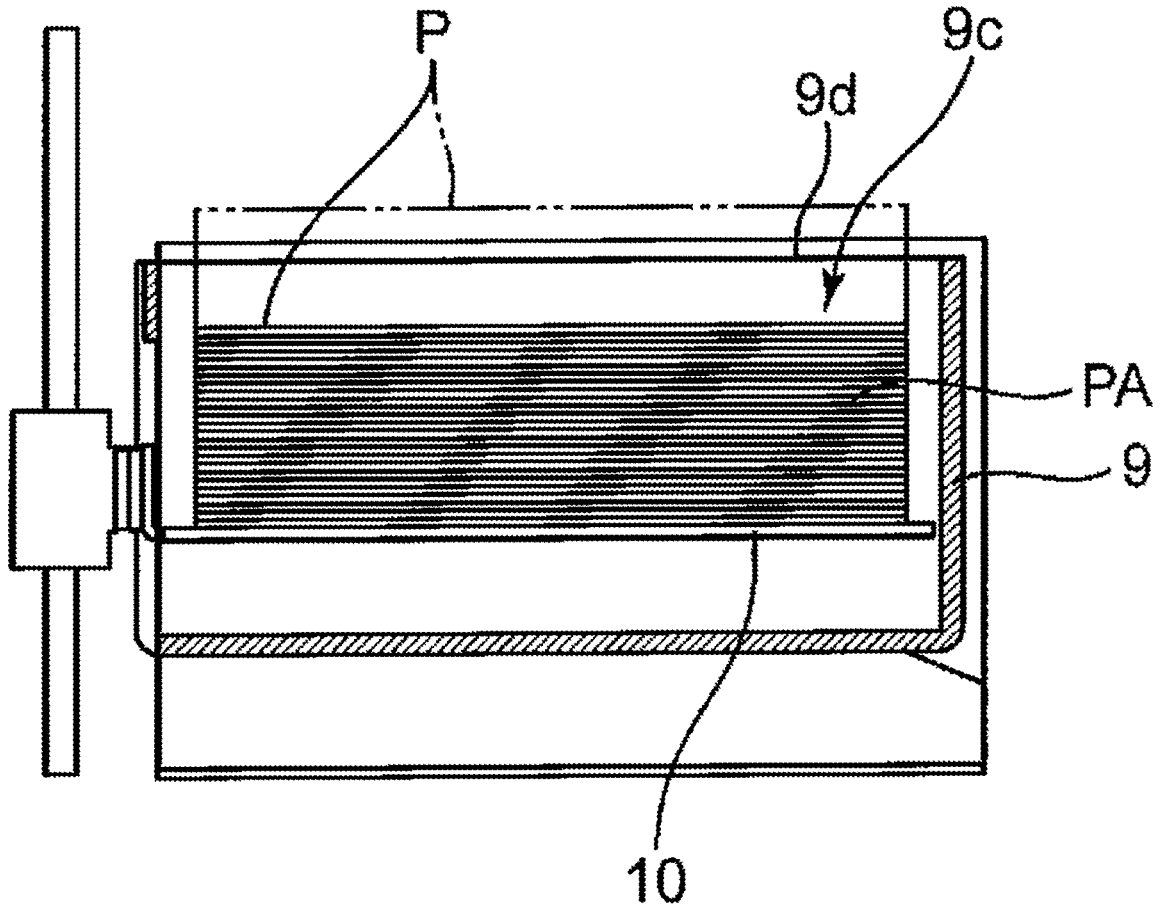
FIG. 10 is a cross-sectional explanatory diagram illustrating a state where stacking of banknotes is complete in the storage box in FIG. 5.

As illustrated in FIG. 10, when stacking of a predetermined number (for example, 500 sheets) of banknotes P is complete in the storage box 9 of a certain stacking unit 6, transport of the banknotes P to the stacking unit 6 is stopped, and stacking completion is informed to an operator by detection means (not illustrated) such as a buzzer or a lamp. Counting of the banknotes P in each stacking unit 6 can be performed by the control unit 12, for example, based on a detection signal of the banknote detection sensor 13 (see FIG. 1).

Figure 11:
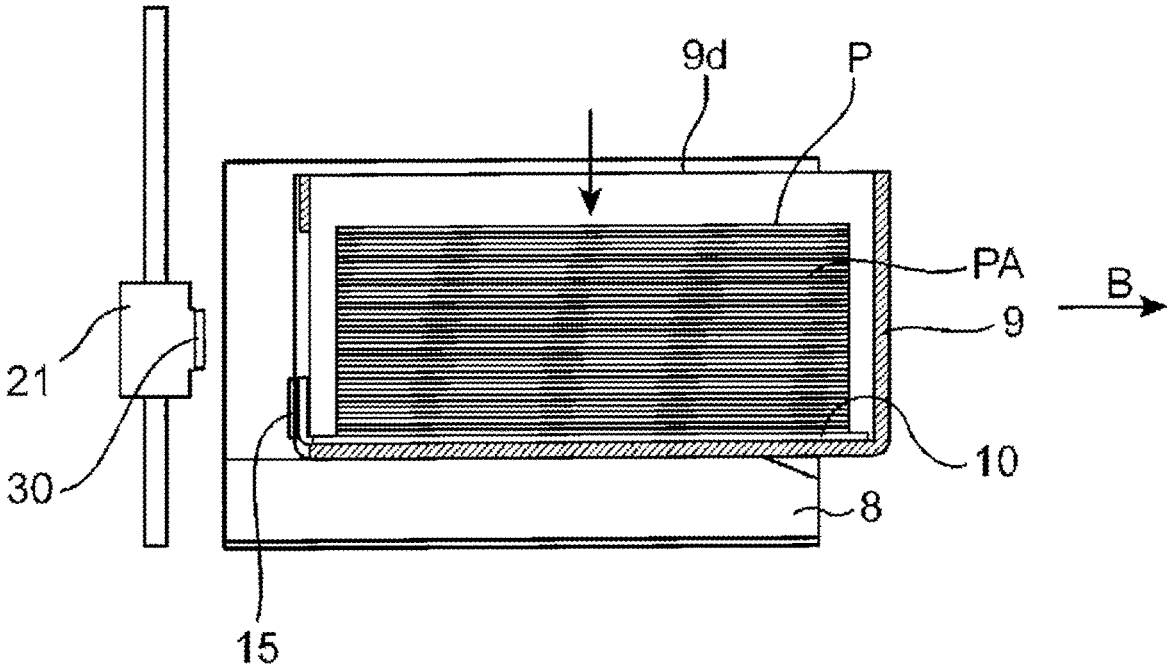
FIG. 11 is a cross-sectional explanatory diagram illustrating a state where attraction of a magnet on the side of the banknote stacking table and a magnet on the side of the linear bush is released and the banknote stacking table is lowered, in the middle of pulling out a storage box in FIG. 10 from a box guide.

After stacking completion of the banknotes P, as illustrated in FIG. 11, the operator moves the storage box 9 along a removal direction B to pull out the storage box 9 from the box guide 8. At this time, the magnet 15 fixed to the banknote stacking table 10 is detached from the magnet 30 fixed to the linear bush 21. Accordingly, coupling between the banknote stacking table 10 and the linear bush 21 is released. As a result, the banknote stacking table 10 and the stacked banknotes PA stacked thereon descend due to the own weight inside the storage box 9. Accordingly, even if the banknote P on the uppermost stage of the stacked banknotes PA is in a state of being above the opening 9*d* at the upper end of the storage box 9 (see the uppermost stage banknote P illustrated by a two-dot chain line) in the stacking completed state in FIG. 10, since the banknote stacking table 10 descends as illustrated in FIG. 11, the entire stacked banknotes PA can be stored in the storage box 9.

Thereafter, as illustrated in FIG. 12, the operator moves the storage box 9 that stores the stacked banknotes PA therein in the removal direction B and takes out the storage box 9 to outside of the box storage space 7*a* of the stacking unit main body 7. Upon completion of removal of the storage box 9, the control unit 12 controls the drive mechanism 23 so that the linear bush 21 is lowered to a predetermined lower position by the drive mechanism 23 described above to stand by in order to return to the stand-by state in FIG. 5.

The storage box 9 taken out from the box storage space 7*a* is transported by the operator to other external devices of the banknote processing device 1 (for example, an automatic teller machine (ATM)). At the time of holding and transporting the storage box 9 that stores the stacked banknotes PA therein, it is preferable to close the opening 9*d* by a lid 32 for security reasons. Further, it is preferable to press the stacked banknotes PA from the upper surface by a compression spring 33 provided on a lower face of the lid 32, since the stacked banknotes PA hardly collapse during transportation.

In the banknote processing device 1 configured as described above, the banknotes P after being processed by the processing unit 4 are stacked in the storage box 9. Specifically, in the stacking unit 6, in a state where the storage box 9 is set in the box storage space 7*a* of the stacking unit main body 7, the banknotes P are stored with scatter thereof being suppressed inside the banknote storage space 9*c* of the storage box 9. The banknotes P can be stacked in a state where the ends of the banknotes P are aligned tidily. It is possible to take out the processed banknotes P to outside from the stacking unit main body 7 in each storage box 9 in a state of the stacked banknotes PA in which the respective ends of the processed banknotes P are aligned tidily on the banknote stacking table 10 in the storage box 9, without binding the processed banknotes P. Therefore, since the operator does not directly touch the stacked banknotes PA, there is no risk of collapse at the time of taking out the stacked banknotes PA from the stacking unit main body 7. Further, after the stacked banknotes PA are taken out from the stacking unit main body 7 in a state of being stored in the storage box 9, the stacked banknotes PA can be aligned more tidily, while the stacked banknotes PA are brought into contact with the side walls 9*b* of the storage box 9.

Further, since the stacked banknotes PA stored in the storage box 9 can be transported by the operator without directly holding the stacked banknotes PA by hand, the number of the banknotes PA that can be stored in the stacking unit 6 can be increased without any restriction of the number of banknotes that can be held at a time ergonomically.

Furthermore, since the stacked banknotes PA can be transported to the next processing step in a state of being stored in the storage box 9, a step to band the stacked banknotes PA is not required. Accordingly, in the banknote processing device 1, the binding mechanism can be omitted, thereby enabling to suppress an increase in size of the banknote processing device, complication thereof, an increase in the manufacturing cost, and the like. Also, a banding member (a rubber band or a tape) is not required and waste resulting from the banding member can be decreased.

Further, by stacking and storing the banknotes P in the storage box 9, the banknotes P can be stably stacked.

In the banknote processing device 1 according to the present embodiment, the stacking unit 6 includes the banknote stacking table 10 and the table moving unit 11. The banknote stacking table 10 is arranged to be vertically movable in the storage box 9. By moving the banknote stacking table 10 to a predetermined upper position by the table moving unit 11 beforehand at the time of storing banknotes P in the storage box 9, a distance from the opening 9*d* in the upper part of the storage box 9 to the banknote stacking table 10 can be reduced. Accordingly, when the banknotes P are loaded into the banknote storage space 9*c* of the storage box 9 from the opening 9*d*, the banknotes P are hardly scattered, and can be stacked in a state where the ends thereof are aligned tidily to form the stacked banknotes PA. As the banknotes P are stacked on the banknote stacking table 10, the banknote stacking table 10 descends due to the own weight of the banknotes P or a driving force of the motor 28 of the drive mechanism 23, thereby enabling to stack the banknotes P in the storage box 9 in a state where the respective ends are aligned more tidily.

In the banknote processing device 1 according to the present embodiment, the stacking unit 6 (stacking unit) includes the banknote stacking table 10 (placing portion) and the table moving unit 11 (placing-portion moving unit); however, the present invention is not limited thereto. For example, the present invention can have a configuration in which the stacking unit does not include the placing portion and the placing-portion moving unit, specifically, a configuration in which the banknote stacking table 10 is not stored inside the storage box 9. In this case, even if the banknotes P are loaded into the storage box 9, the banknotes P can be stacked in a state where the ends are aligned more tidily, as compared with a case where the banknotes P are loaded into the box storage space 7*a* in a state where the storage box 9 is not provided and can be taken out to outside of the banknote processing device 1 in the stacked state.

In the banknote processing device 1 according to the present embodiment, a coupling unit having the magnets 15 and 30 is provided as a coupling unit that detachably couples the banknote stacking table 10 and the linear bush 21 with each other. The magnets 15 and 30 are provided in any one or both of the banknote stacking table 10 and the linear bush 21. The magnets 15 and 30 are arranged so as to detachably couple the banknote stacking table 10 and the linear bush 21 with each other in a state where the storage box 9 is stored in the box storage space 7*a*, and release the coupling in a state where the storage box 9 is out of the box storage space 7*a*. According to such a configuration, the operator can detachably couple the banknote stacking table 10 in the storage box 9 with the linear bush 21 in the table moving unit 11 by the magnets 15 and 30, by inserting the storage box 9 into the box storage space 7*a* of the stacking unit main body 7. Therefore, the operator can easily perform an operation to set the storage box 9 in the box storage space 7*a* of the stacking unit main body 7. In a state where the banknote stacking table 10 and the linear bush 21 are coupled with each other, the linear bush 21 moves upward and then the banknote stacking table 10 can be raised and arranged close to the opening 9*d* in the upper part of the storage box 9.

On the other hand, at the time of taking out the banknotes P stored in the storage box 9, the operator takes out the storage box 9 from the box storage space 7*a* of the stacking unit main body 7, thereby enabling to release the coupling between the banknote stacking table 10 and the linear bush 21 by the magnets 15 and 30. At this time, the banknote stacking table 10 released from coupling with the linear bush 21 descends inside the storage box 9, while maintaining a state where the banknotes P are placed thereon. Accordingly, there is no risk that the banknotes P drop out of the opening 9*d* in the upper part of the storage box 9, and the operator can easily perform an operation to take out the storage box 9 in which the banknotes P are stored from the stacking unit main body 7.

The slit 9*e* for magnet coupling that penetrates the side wall 9*b*1 and extends vertically is formed in the side wall 9*b*1 of the storage box 9. According to the configuration, the magnets 15 and 30 can strongly couple the banknote stacking table 10 in the storage box 9 with the linear bush 21 of the table moving unit 11 outside the storage box 9 through the slit 9*e* formed in the side wall 9*b*1 of the storage box 9. Further, since the magnets 15 and 30 move vertically along the slit 9*e*, following the vertical movement of the linear bush 21, even if the linear bush 21 moves vertically, contact of the magnets 15 and 30 with the side wall 9*b*1 of the storage box 9 can be avoided. Therefore, there is no risk that the coupling between the linear bush 21 and the banknote stacking table 10 by the magnets 15 and 30 is released when the linear bush 21 and the banknote stacking table 10 move vertically in a coupled state.

According to the present embodiment, the table moving unit 11 includes the extension coil spring 29 as an energizing member that provides an upward energizing force to the linear bush 21. According to the configuration, in a state where the storage box 9 is stored in the box storage space 7*a* of the stacking unit main body 7, the extension coil spring 29 can provide the upward energizing force to the banknote stacking table 10 via the linear bush 21. Accordingly, the banknote stacking table 10 can be raised by the energizing force of the extension coil spring 29 and arranged close to the opening 9*d* in the upper part of the storage box 9. Therefore, another driving source for raising the banknote stacking table 10 is not required. Further, as the banknotes P are stacked on the banknote stacking table 10, the banknote stacking table 10 gradually descends against the energizing force of the extension coil spring 29 due to the weight of the stacked banknotes P, so that the banknotes P can be stacked on the banknote stacking table 10 while the respective ends are aligned. Accordingly, another driving source is not required for lowering the banknote stacking table 10 as the banknotes P are stacked on the banknote stacking table 10. Therefore, a driving source for vertically moving the banknote stacking table 10 can be omitted or simplified.

In the banknote processing device 1 according to the embodiment described above, the table moving unit 11 includes the energizing member such as the extension coil spring 29 that energizes the linear bush 21 upward. However, the present invention is not limited thereto, and it is allowable that the energizing member is not provided, and it suffices to provide the drive mechanism 23 that vertically moves the linear bush 21. On the other hand, even in the configuration including the extension coil spring 29, the drive mechanism 23 that can lower the linear bush 21 is required to move the linear bush 21 to the lower position at the time of inserting the storage box 9 into the box storage space 7*a* and at the time of taking out the storage box 9 from the box storage space 7*a*.

In the embodiment described above, the banknote stacking table 10 and the linear bush 21 are detachably coupled with each other by the magnets 15 and 30; however, the present invention is not limited thereto. As another embodiment of the paper sheet processing device according to the present invention, as illustrated in FIGS. 13 to 16, a support arm 34 extending horizontally from the linear bush 21 can be provided as a support portion for supporting the banknote stacking table 10 from below. In this case, the support arm 34 can raise the banknote stacking table 10 by supporting the banknote stacking table 10 from below in a state capable of being detached from the banknote stacking table 10.

Figure 13:
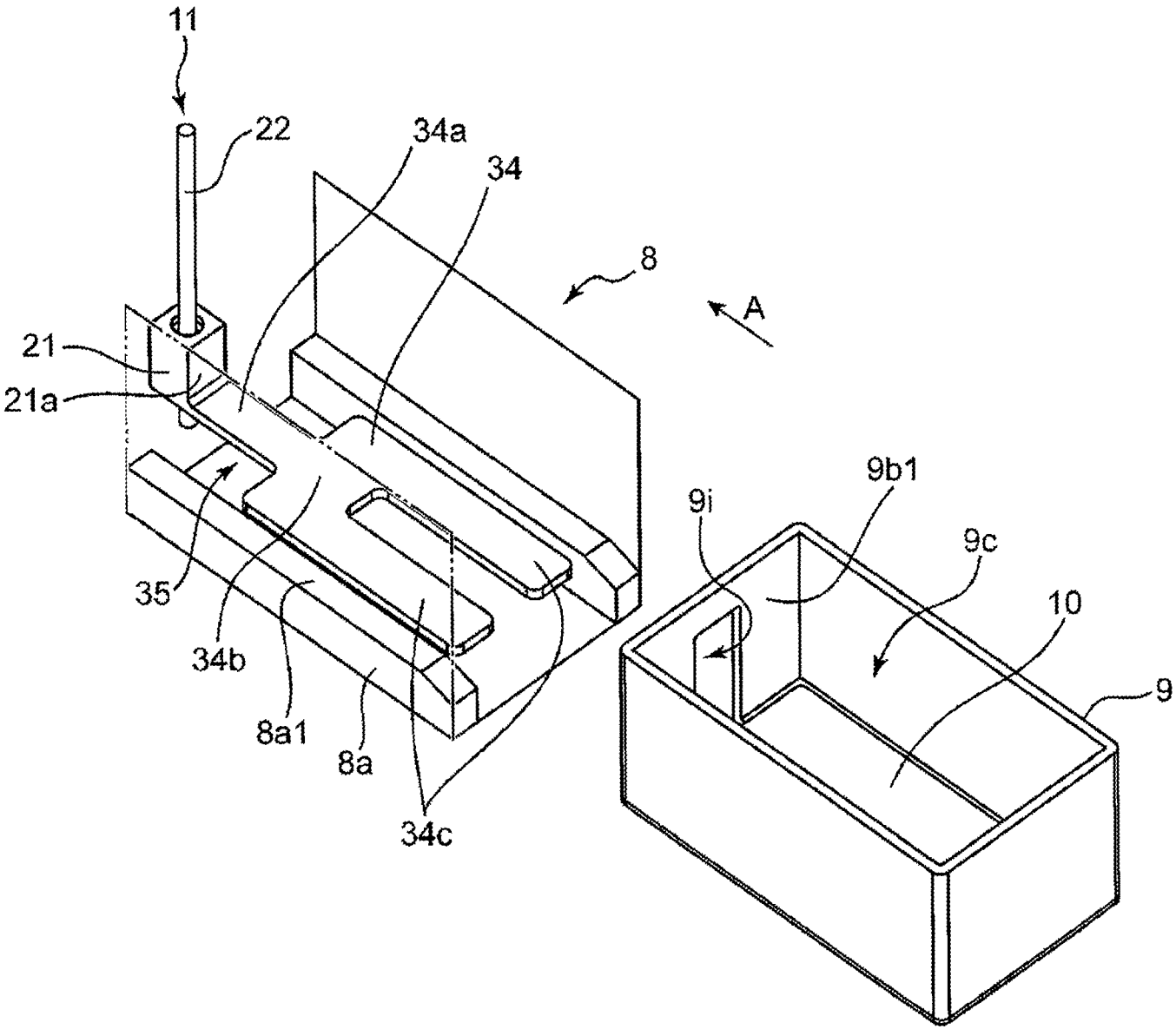
FIG. 13 is a cross-sectional explanatory diagram illustrating a state where a support arm of a moving member is arranged in the bottom of the box guide and before the storage box is inserted into the box guide in a paper sheet processing device according to another embodiment of the present invention.

That is, as illustrated in FIG. 13, the table moving unit 11 includes a moving member 35 capable of moving vertically along the guide rod 22. The table moving unit 11 illustrated in FIG. 13 also includes the drive mechanism 23 and the extension coil spring 29 illustrated in FIG. 4. However, illustrations thereof are omitted in FIG. 13.

The moving member 35 illustrated in FIG. 13 includes the linear bush 21 described above and the support arm 34. The support arm 34 extends horizontally (specifically, in a direction opposite to the insertion direction A) from an outer surface of a casing 21 *a* of the linear bush 21. The support arm 34 has a flat plate shape having a flat upper surface capable of supporting the banknote stacking table 10 from below. Specifically, the support arm 34 illustrated in FIG. 13 includes a root portion 34 *a* with one end coupled to the casing 21 *a*, an intermediate portion 34 *b* coupled to the other end of the root portion 34 *a*, and a pair of tip portions 34 *c* branched from the intermediate portion 34 *b*. That is, the support arm 34 has an approximate Y-shape. The banknote stacking table 10 can be placed on the support arm 34, and in other words, can be attached to or detached from the support arm 34. Therefore, the banknote stacking table 10 can be in a state of being vertically movable by the moving member 35, and in a state of being positioned in the storage box 9 and away from the moving member 35.

It suffices that the support arm 34 has a shape capable of functioning as the support portion by supporting the banknote stacking table 10 from below, and the shape of the support arm 34 is not limited to the approximate Y-shape and the support arm 34 can have another shape.

Figure 15:
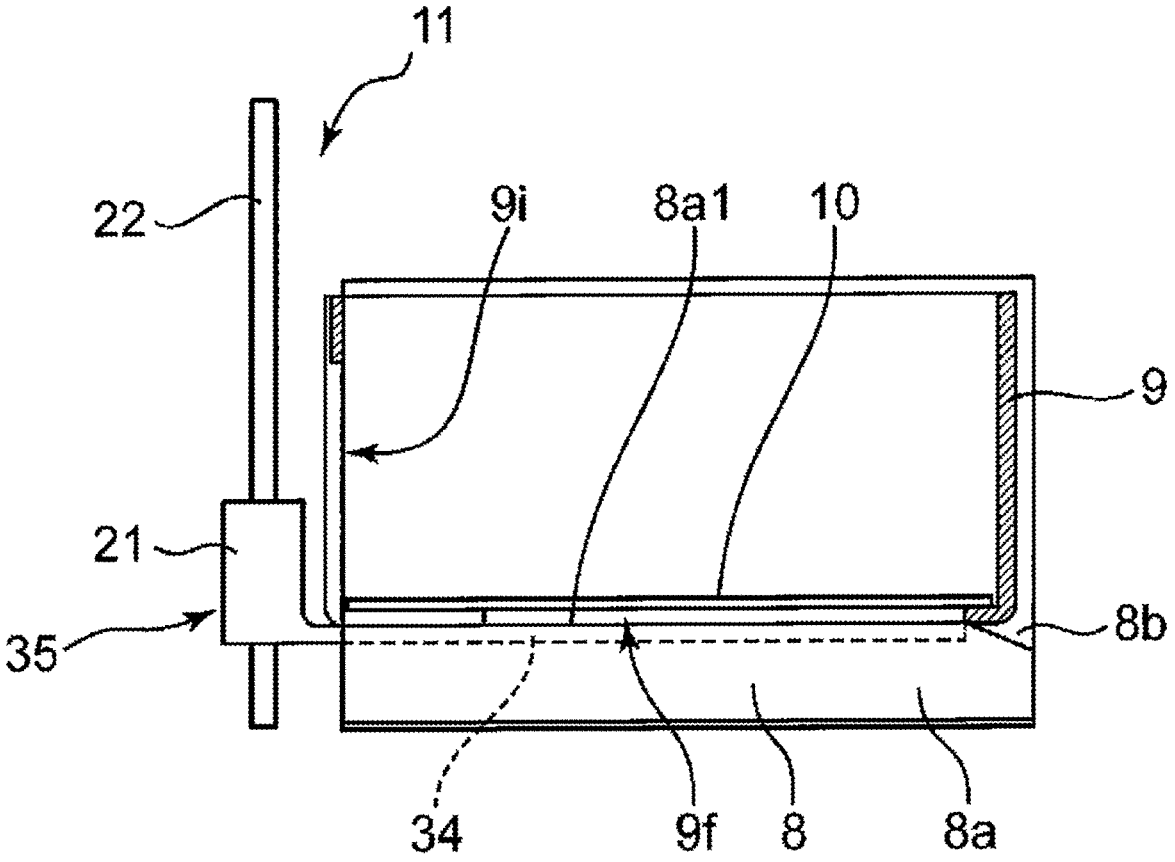
FIG. 15 is a cross-sectional explanatory diagram illustrating a state where the banknote stacking table is arranged above the support arm in FIG. 13.
Figure 16:
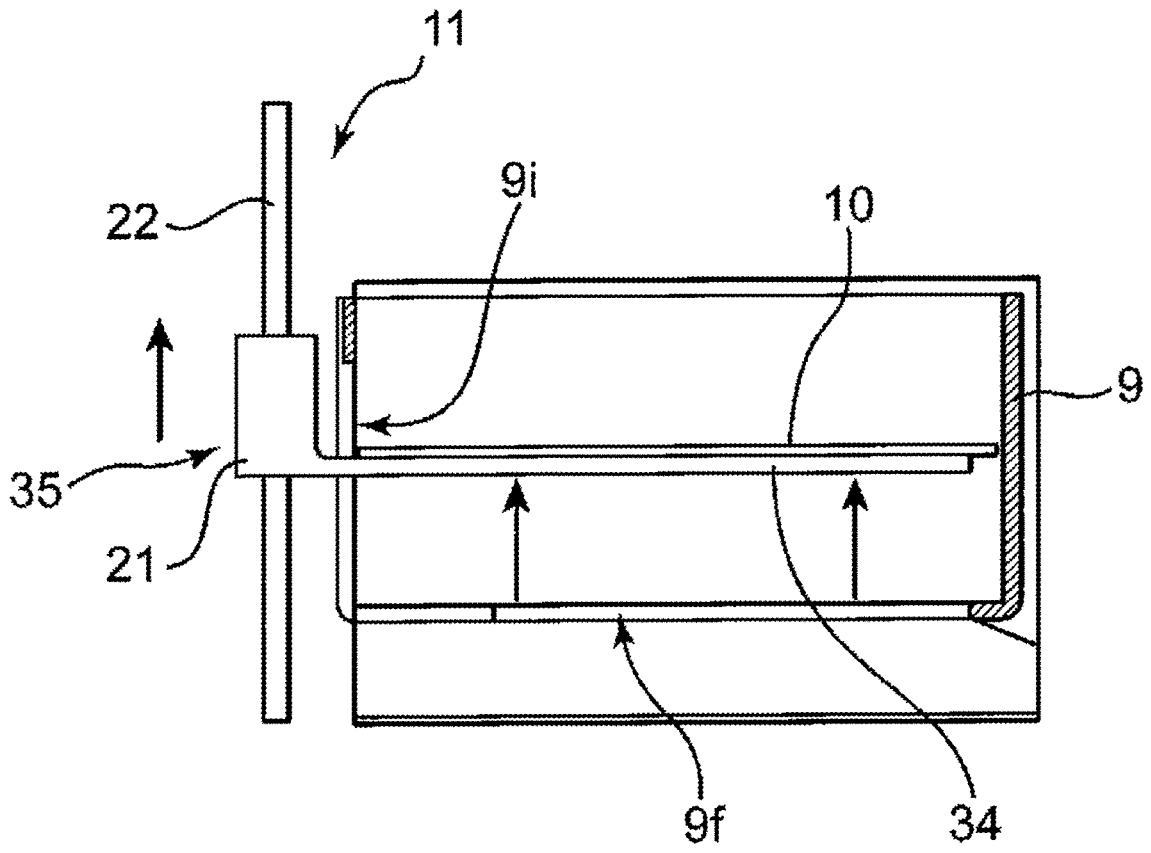
FIG. 16 is a cross-sectional explanatory diagram illustrating a state where the linear bush and the banknote stacking table are being raised in a state where the support arm in FIG. 15 supports the banknote stacking table from below.

As illustrated in FIG. 13 and FIG. 15, the support arm 34 of the moving member 35 is arranged on the bottom portion of the box guide 8, specifically, at a lower position than that of an upper surface 8*a*1 of the support block 8*a*, in a state before the storage box 9 is inserted into the box guide 8 inside the box storage space 7*a* (see FIG. 1). Accordingly, the storage box 9 can be smoothly inserted into the box guide 8 without coming into contact with the support arm 34.

Figure 14:
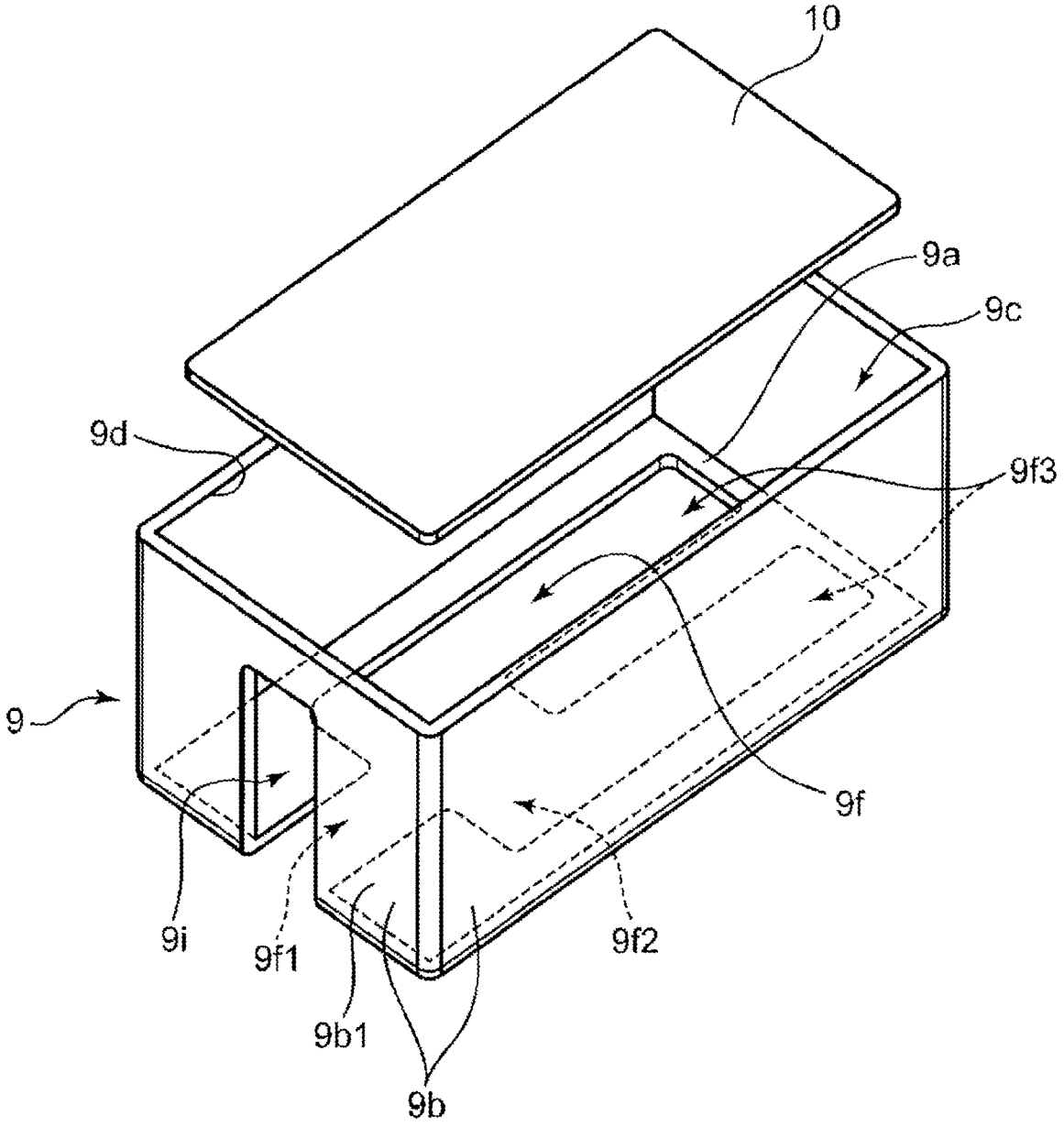
FIG. 14 is a perspective view of the storage box and a banknote stacking table in FIG. 13.

On the other hand, the storage box 9 illustrated in FIG. 14 is the same as the storage box 9 illustrated in FIG. 2 described above in that the storage box 9 has the bottom wall 9*a* and the four side walls 9*b* standing upward from the edges of the bottom wall 9*a*, but is different therefrom in that the storage box 9 has a bottom opening 9*f* and a first slit 9*i*.

That is, the first slit 9*i* for allowing passage of the support arm, which penetrates the side wall 9*b*1 and extends vertically, and through which the root portion 34*a* of the support arm 34 can pass, is formed in the side wall 9*b*1 on the front side of the storage box 9. The bottom opening 9*f* communicating with the first slit 9*i* is formed in the bottom wall 9*a*, through which the support arm 34 can pass.

The bottom opening 9*f* has a shape corresponding to the shape of the support arm 34 so that the support arm 34 can pass therethrough. Specifically, the bottom opening 9*f* includes a first portion 9*f*1 corresponding to the root portion 34*a* of the support arm 34, a second portion 9*f*2 corresponding to the intermediate portion 34*b*, and a pair of third portions 9*f*3 corresponding to the pair of tip portions 34*c*. The first portion 9*f*1 of the bottom opening 9*f* communicates with the first slit 9*i* in the side wall 9*b*1.

Therefore, in the banknote processing device configured as described above, as illustrated in FIG. 15 and FIG. 16, in a state where the storage box 9 is stored in the box storage space 7*a* of the stacking unit main body 7, by raising the moving member 35 of the table moving unit (that is, the linear bush 21 and the support arm 34) by the extension coil spring 29 or the drive mechanism 23 described above, the support arm 34 of the moving member 35 is inserted into the storage box 9 through the bottom opening 9*f* in the bottom wall 9*a* and the first slit 9*i* in the side wall 9*b*1 of the storage box 9, and can be raised in the storage box 9 along the first slit 9*i*. Accordingly, the banknote stacking table 10 in the storage box 9 can be supported from below by the support arm 34 of the moving member 35 and can be vertically moved together with the moving member 35.

Figure 17:
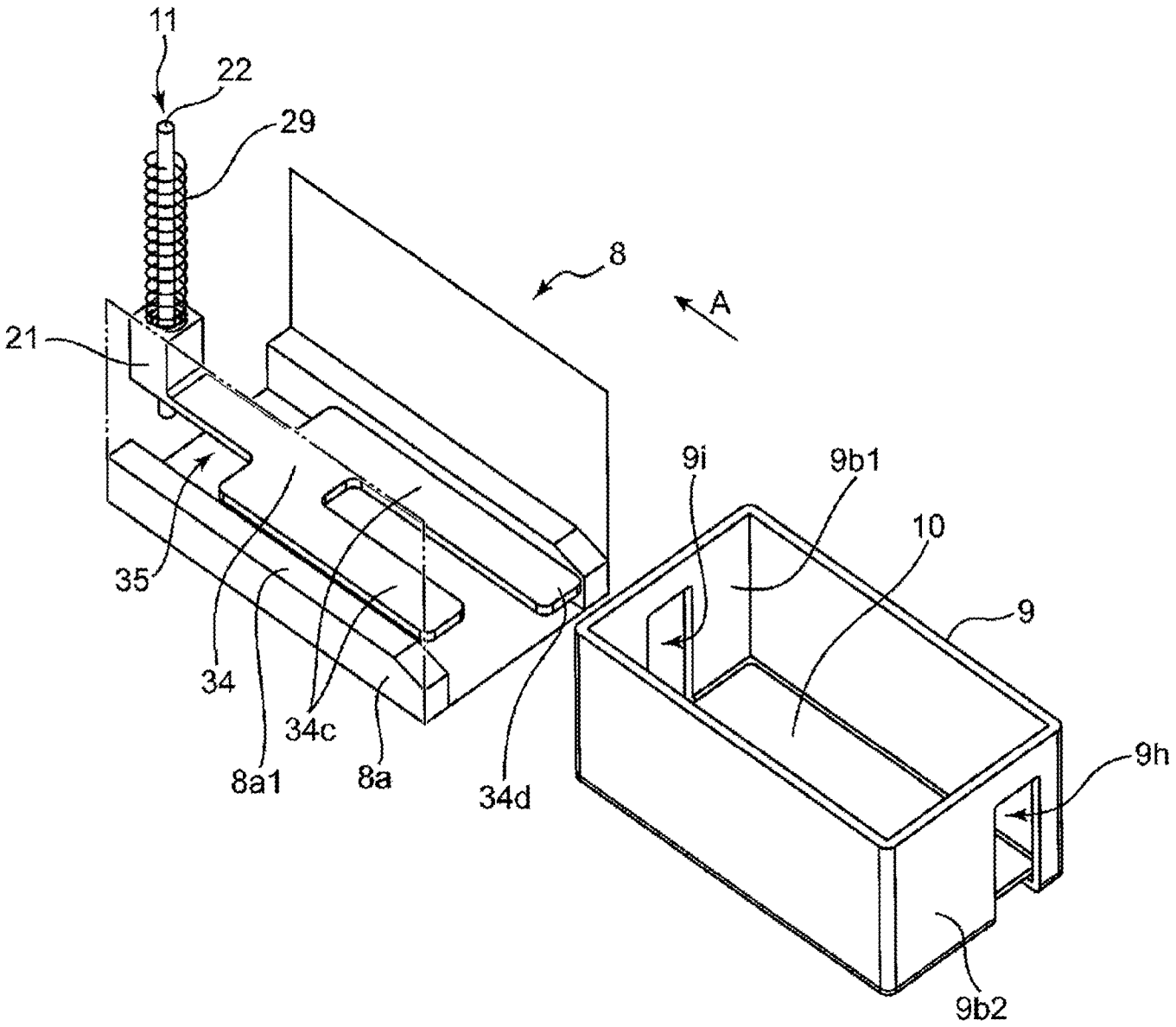
FIG. 17 is a perspective explanatory diagram illustrating a configuration in which an operation portion that can be operated by a finger is provided in a tip portion of the support arm of the moving member and a slit into which the operation portion can be inserted is formed on a side wall of the storage box, in a paper sheet processing device according to still another embodiment of the present invention.

On the other hand, when the storage box 9 is taken out from the box storage space 7*a*, by automatically lowering the moving member 35 by driving the motor 28 (see FIG. 4) of the drive mechanism 23 described above, the support arm 34 can be detached and taken out to outside of the storage box 9 from the bottom opening 9*f* in the bottom wall 9*a* of the storage box 9. As illustrated in FIG. 17 described below, when an operation portion 34*d* is provided at the tip portion of the support arm 34, by pressing down the operation portion 34*d* by a finger, the moving member 35 can be lowered manually.

As described above, by detaching the support arm 34 to outside of the storage box 9 through the bottom opening 9*f*, the storage box 9 can be taken out from the stacking unit main body 7, while avoiding an interference with the support arm 34. Further, since the banknote stacking table 10 can descend to return to a predetermined lower position, following the downward movement of the support arm 34, there is no risk of dropout of the banknotes P from the opening 9*d* in the upper part of the storage box 9, at the time of taking out the storage box 9 from the stacking unit main body 7. As described above, since the interference between the storage box 9 and the support arm 34 and outflow of the banknotes P from the opening 9*d* can be avoided, an operation to take out the storage box 9 that stores the stacked banknotes PA therein from the stacking unit main body 7 can be easily performed.

In the banknote processing device according to the embodiment illustrated in FIGS. 13 to 16, since the moving member 35 has the support arm 34, the banknotes P can be stacked on the support arm 34, even in a state where the storage box 9 is not provided. In this case, the stacked banknotes PA can be taken out by the hands of an operator. Therefore, even if there are not enough storage boxes 9, the stacking operation of the banknotes P can be continuously performed, which is practically preferable.

Figure 18:
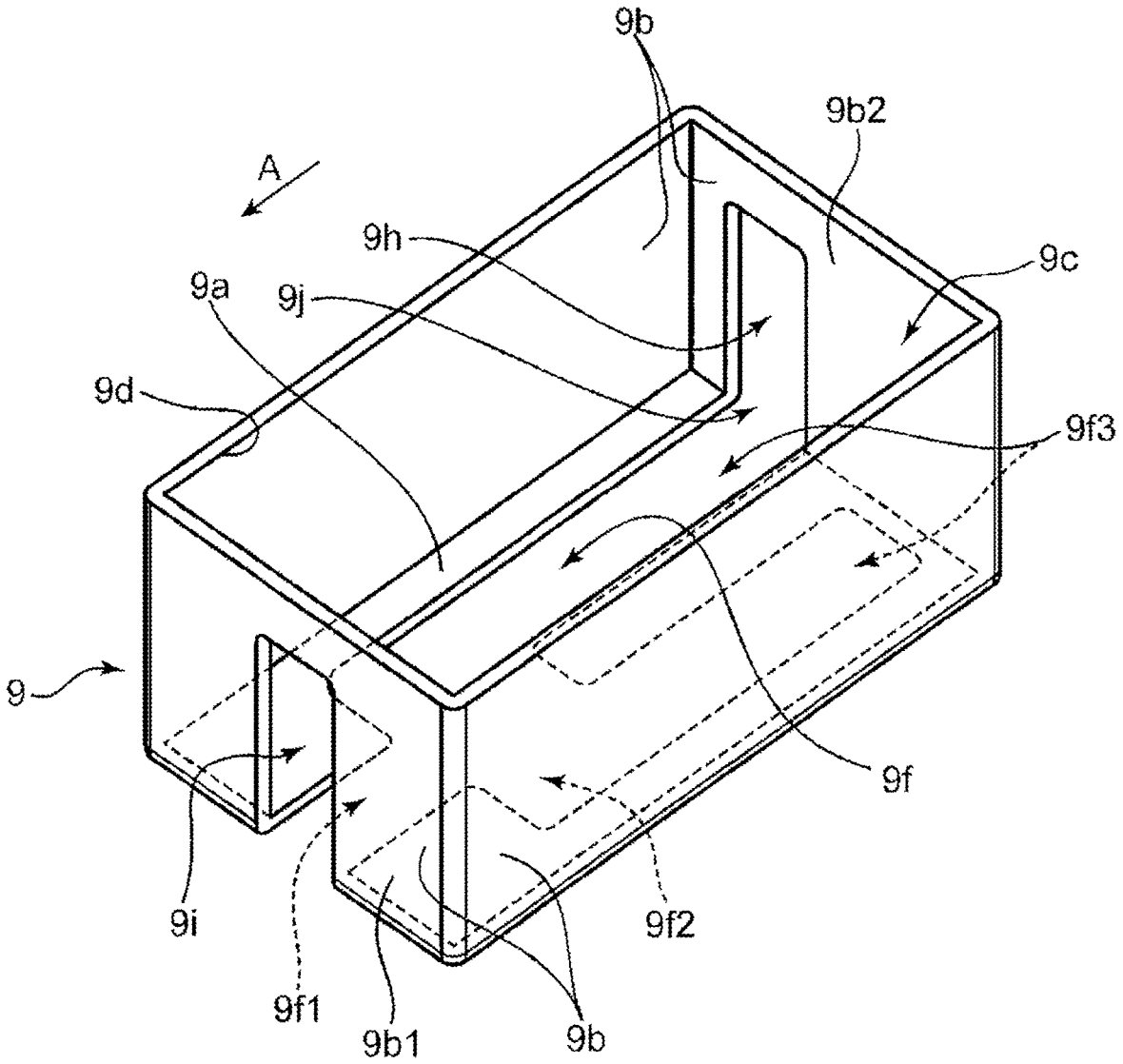
FIG. 18 is a perspective view of the storage box in FIG. 17.
Figure 19:
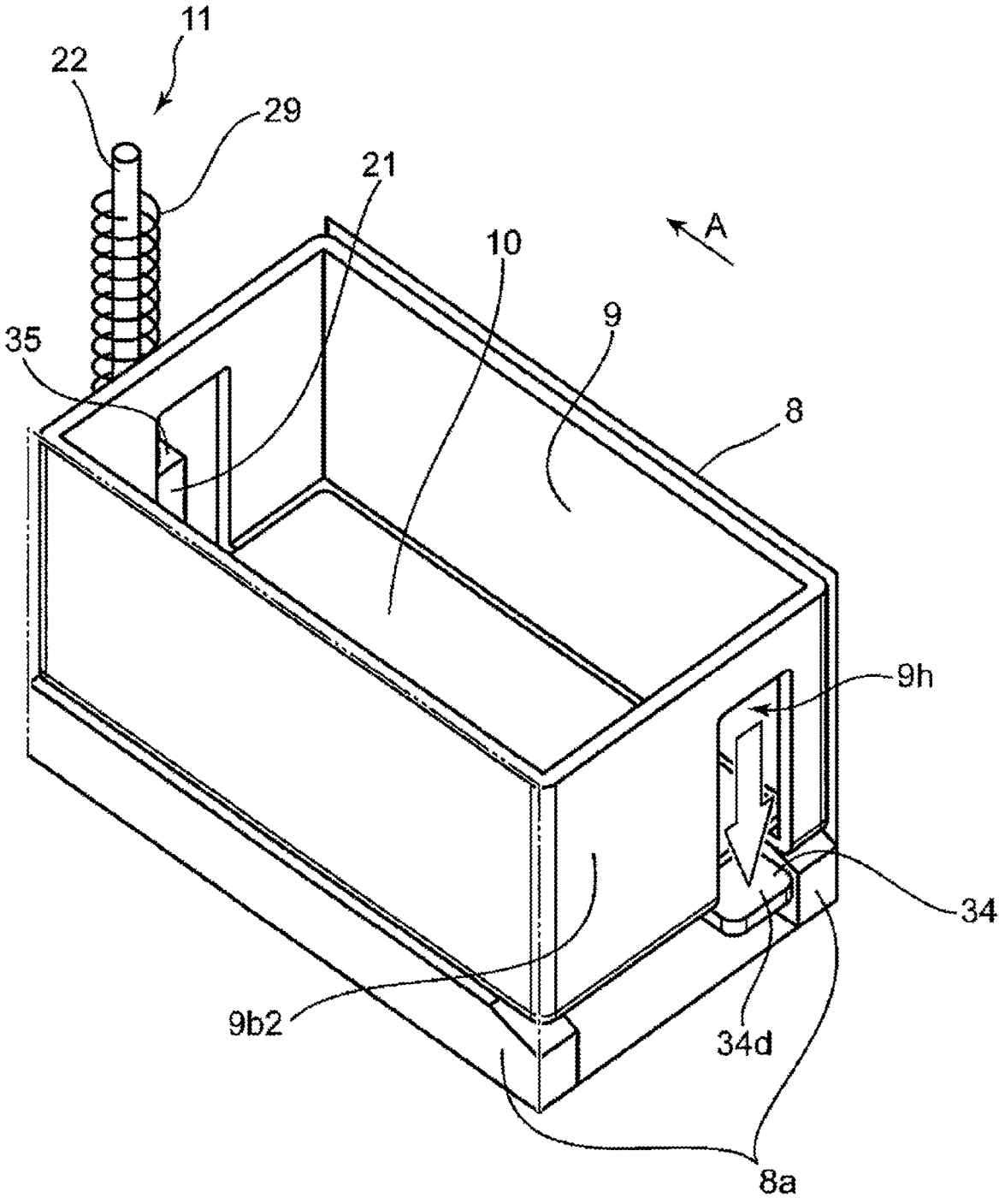
FIG. 19 is perspective explanatory diagram illustrating an operation of lowering the banknote stacking table supported by the support arm from below manually by pressing down the operation portion of the tip portion of the support arm in FIG. 17 from outside by a finger.

As still another embodiment of the paper sheet processing device according to the present invention, as illustrated in FIGS. 17 to 19, in the configuration in which the moving member 35 has the support arm 34 as described above, the support arm 34 can have the operation portion 34*d* so that the support arm 34 can be pressed down by hand. Specifically, the table moving unit 11 has the extension coil spring 29 that provides the upward energizing force to the moving member 35. The support arm 34 of the moving member 35 includes the operation portion 34*d* that extends in the horizontal direction so that it abuts on a finger to receive a downward operating force from the finger.

The operation portion 34*d* is formed by extending an end of one of the pair of tip portions 34*c* of the support arm 34 in the direction opposite to the insertion direction A.

On the other hand, in a side wall 9*b*2 on the rear side in the insertion direction A of the storage box 9, a second slit 9*h* for allowing passage of the operation portion 34*d* is formed as another slit separate from the first slit 9*i* in the side wall 9*b*1 on the front side. The second slit 9*h* penetrates the side wall 9*b*2 and extends vertically so that the operation portion 34*d* can pass therethrough. The second slit 9*h* communicates with a third portion 9*f*3 of the bottom opening 9*f* in the bottom wall 9*a* via a communicating portion 9*j*.

The operation portion 34*d* of the support arm 34 can project to outside of the storage box 9 through the second slit 9*h* formed in the side wall 9*b*2 on the rear side in the insertion direction A, in a state where the support arm 34 are inserted into the storage box 9.

Therefore, in the banknote processing device configured as illustrated in FIGS. 17 to 19, at the time of lowering the moving member 35 (that is, the linear bush 21 and the support arm 34), an operator can lower the moving member 35 against the energizing force of the extension coil spring 29 by pressing down the operation portion 34*d* of the support arm 34 by a finger. Accordingly, a driving source for lowering the moving member 35 is not required. Further, since the moving member 35 can be raised by the energizing force of the extension coil spring 29, a driving source that moves the moving member 35 is not required other than the extension coil spring 29, thereby simplifying the configuration of the table moving unit 11.

In this configuration, the operation portion 34*d* of the support arm 34 projects to outside of the storage box 9 through the second slit 9*h* formed in the side wall 9*b*2 on the rear side in the insertion direction A, even in a state where the support arm 34 is inserted into the storage box 9. Therefore, by pressing down the operation portion 34*d* by a finger, both the support arm 34 and the banknote stacking table 10 can be lowered against the energizing force of the extension coil spring 29, while maintaining a state where the support arm 34 supports the banknote stacking table 10 from below inside the storage box 9. Further, the support arm 34 can be detached and taken out to outside of the storage box 9 from the bottom opening 9*f* in the bottom wall 9*a* of the storage box 9 by descending. Accordingly, the storage box 9 that stores the stacked banknotes PA therein can be easily taken out from the box guide 8 in the box storage space 7*a*, without interfering with the support arm 34.

The banknote processing device illustrated in FIGS. 17 to 19 can have a temporary joint mechanism such as a ratchet mechanism to temporarily join the moving member 35 to a predetermined lower position illustrated in FIG. 17 (specifically, at a position at which the support arm 34 is lower than the upper surface 8*a*1 of the support block 8*a* of the box guide 8), when the moving member 35 (the linear bush 21 and the support arm 34) is lowered by pressing down the operation portion 34*d* by a finger. In this case, before the storage box 9 is inserted into the box guide 8, the moving member 35 can be temporarily joined to the predetermined lower position illustrated in FIG. 17 by the temporary joint mechanism. After the storage box 9 is inserted into the box guide 8, by releasing the temporary joint of the moving member 35 by the temporary joint mechanism by an operation such as pressing down the operation portion 34*d* again by a finger, the support arm 34 and the moving member 35 can be raised by a restoring force of the extension coil spring 29.

Figure 20:
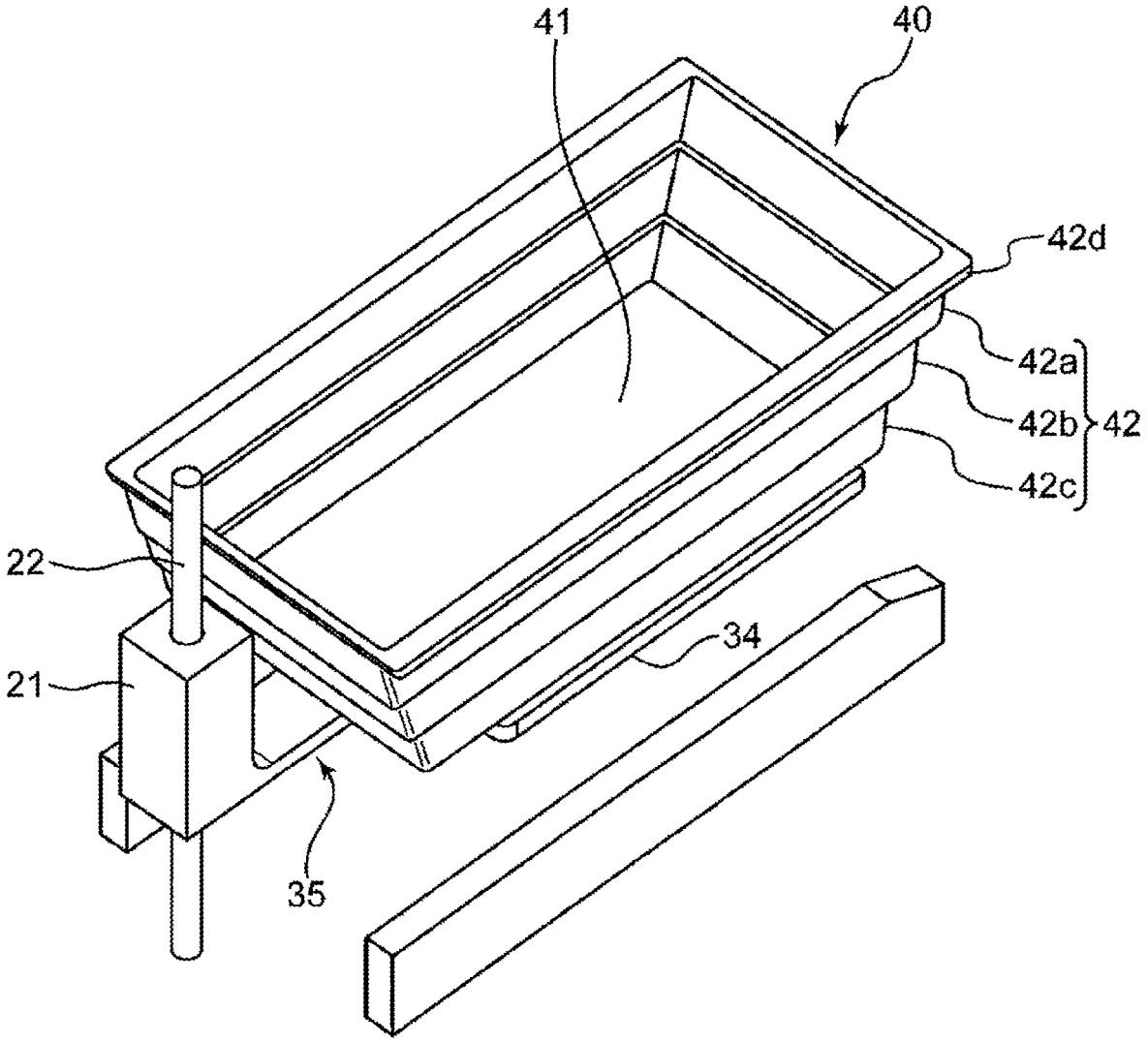
FIG. 20 is perspective explanatory diagram illustrating a configuration in which an extendable storage box is included in a paper sheet processing device according to still another embodiment of the present invention.
Figure 21:
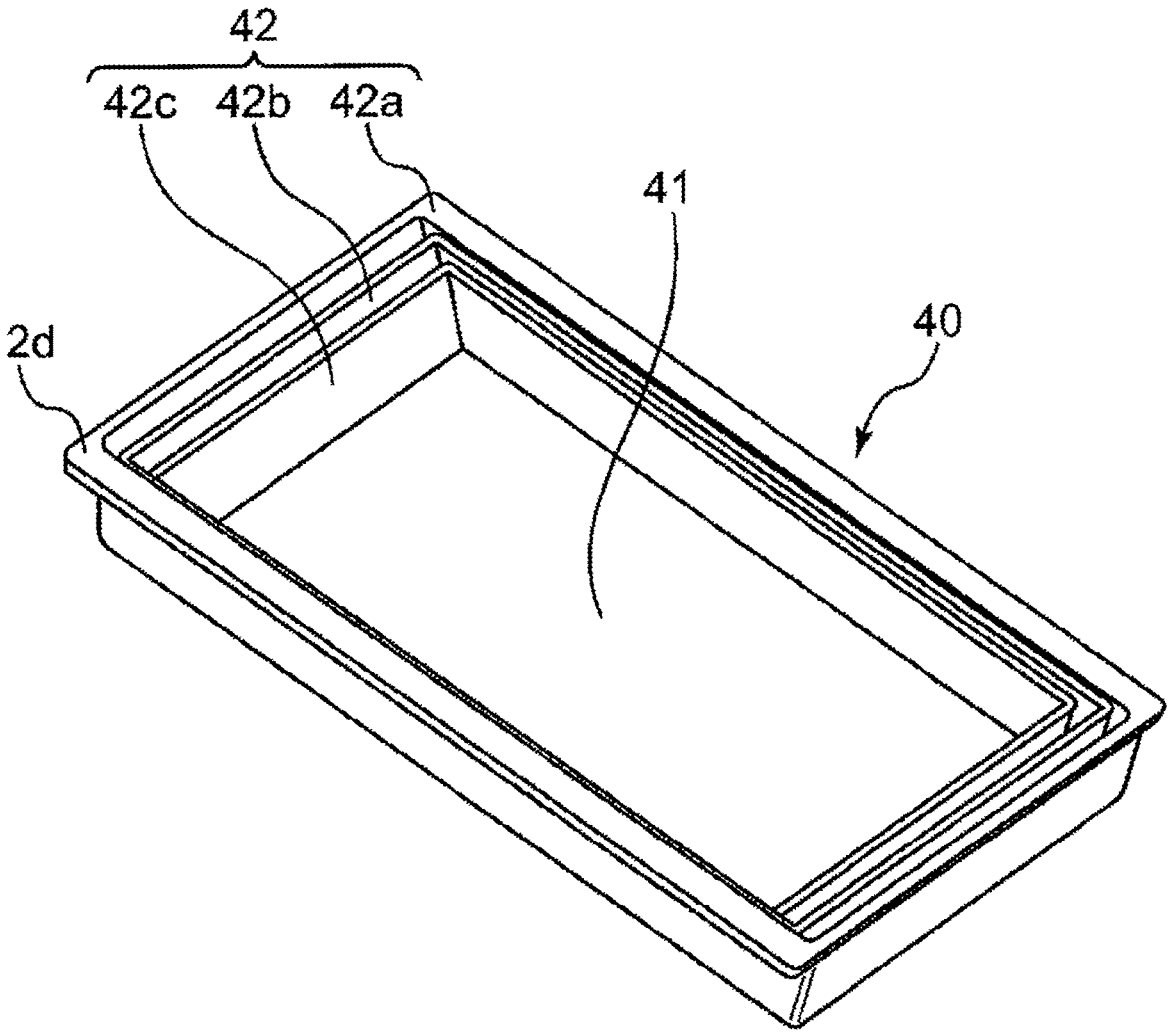
FIG. 21 is a perspective view illustrating a state where the storage box in FIG. 20 is folded.

As still another embodiment of the paper sheet processing device of the present invention, as illustrated in FIGS. 20 to 24, a storage box 40 can be configured to be vertically extendable. Specifically, as illustrated in FIGS. 20 to 21, the storage box 40 includes a vertically movable bottom wall 41, and a side wall 42 vertically extendable with the vertical movement of the bottom wall 41. The bottom wall 41 has an upper surface on which the banknotes P can be placed, and functions as a placing portion vertically movable (a placing portion such as the banknote stacking table 10 described above) inside the storage box 40 (specifically, a space inside the side wall 42).

The bottom wall 41 of the storage box 40 is placed on the support arm 34 of the moving member 35 described above inside the box storage space 7*a*.

The vertically extendable side wall 42 is formed by superposing a plurality of tapered frames 42*a*, 42*b*, and 42*c* having different sizes on each other. The tapered frames 42*a*, 42*b*, and 42*c* are rectangular frames and respectively have a tapered shape as moving downward. In a state where the side wall 42 are extended, the tapered frames 42*a*, 42*b*, and 42*c* are in a state where ends of adjacent frames are engaged with each other. The side wall 42 needs only to be vertically extendable and can be configured by an accordion frame or a frame made of a soft material such as a hood cloth. The side wall 42 can be a frame that shrinks due to own elastic force even if it is extended, such as the accordion frame. In this case, the bottom wall 41 can be positioned at the upper position due to the elastic force of the side wall 42.

A flange 42*d* projecting outward of the side wall 42 is formed at an upper end of the side wall 42.

It suffices that the side wall 42 is vertically extendable with the vertical movement of the bottom wall 41, and the bottom wall 41 is not limited to be firmly fixed thereto. Therefore, the bottom wall 41 can be detachable from the side wall 42.

According to the embodiment illustrated in FIGS. 20 to 24, as a support portion that supports the flange 42*d* at the upper end of the side wall 42 of the storage box 40 at a predetermined height inside the box storage space 7*a*, the pair of guide plates 8*b* of the box guide 8 respectively have, for example, an upper end face 8*b*1. Since the flange 42*d* at the upper end of the side wall 42 is placed on the upper end faces 8*b*1 of the guide plates 8*b*, the side wall 42 is engaged with the upper ends of the guide plates 8*b*. The support portion that supports the flange 42*d* at the upper end of the side wall 42 can be a portion other than the upper end face 8*b*1 of the guide plate 8*b*.

As described above, according to the configuration of the embodiment illustrated in FIGS. 20 to 24, the storage box 40 includes the vertically movable bottom wall 41 that functions as a placing portion on which banknotes can be placed, and the side wall 42 vertically extendable with the vertical movement of the bottom wall 41. Further, as the support portion that supports the upper end of the side wall 42 at the predetermined height inside the box storage space 7*a*, the guide plates 8*b* of the box guide 8 respectively have the upper end face 8*b*1. According to this configuration, by vertically moving the bottom wall 41 of the storage box 40 that functions as the placing portion on which the banknotes are placed, the storage box 40 can be deformed to a state of being extended vertically and to a state of being folded.

Figure 22:
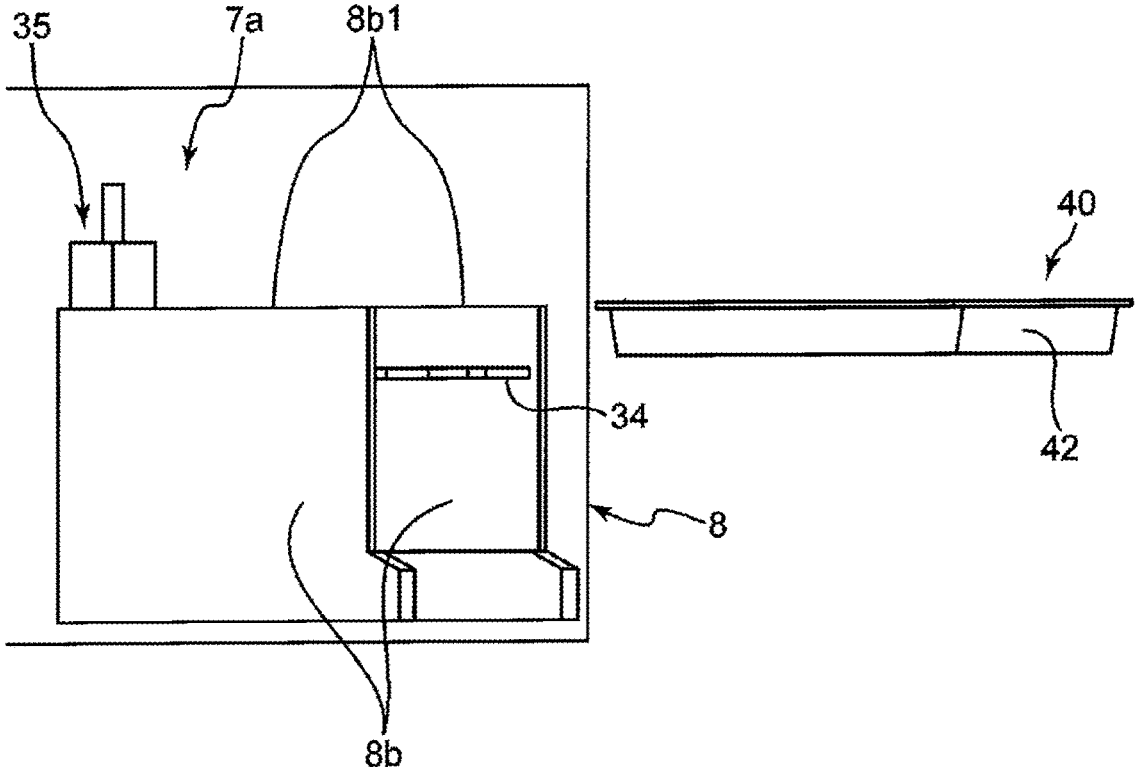
FIG. 22 is perspective explanatory diagram illustrating a process of attaching the folded storage box in FIG. 21 to the box guide.
Figure 23:
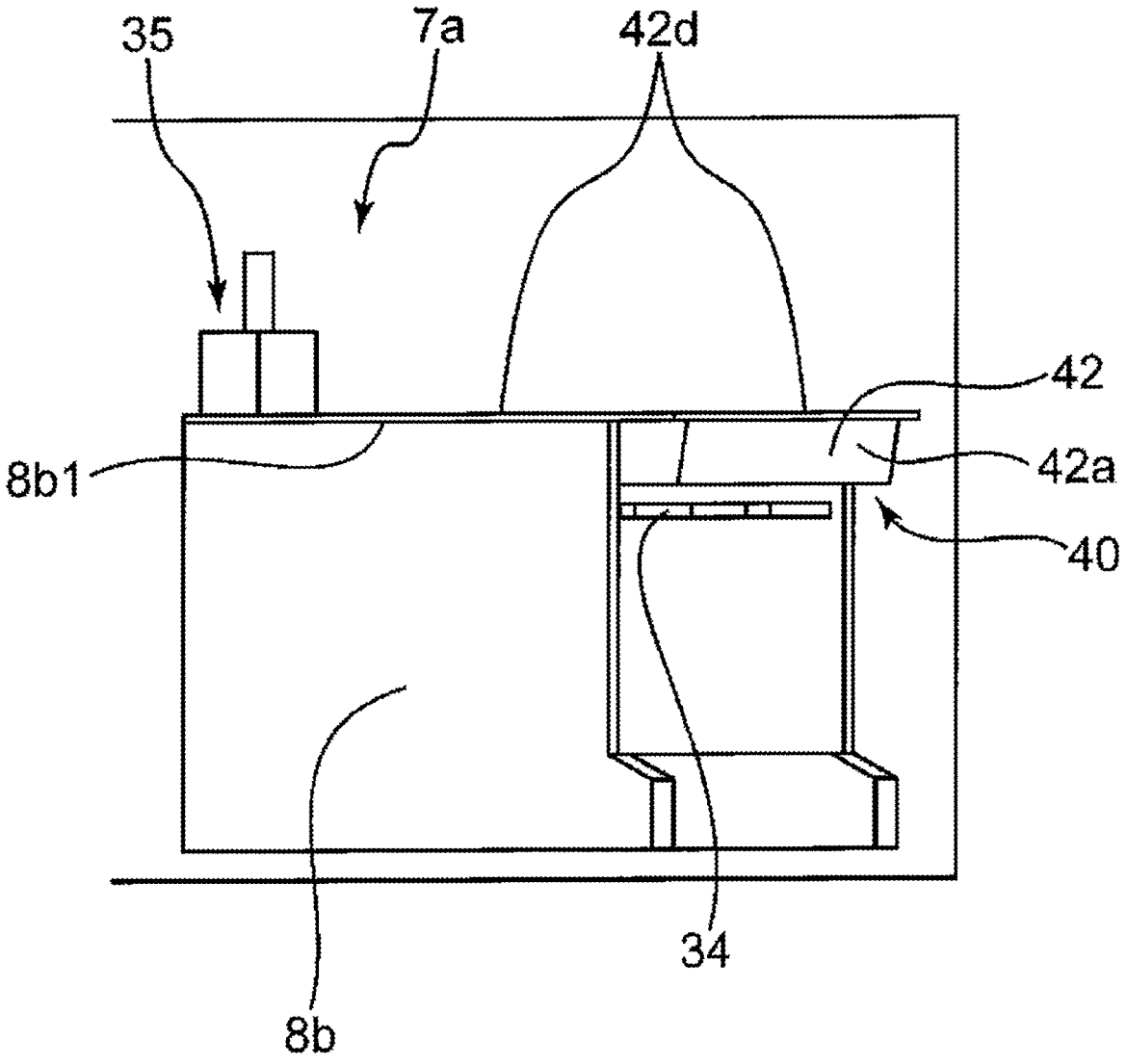
FIG. 23 is perspective explanatory diagram illustrating a state where an upper end of a side wall of the folded storage box in FIG. 22 is supported by an upper end face of the box guide.
Figure 24:
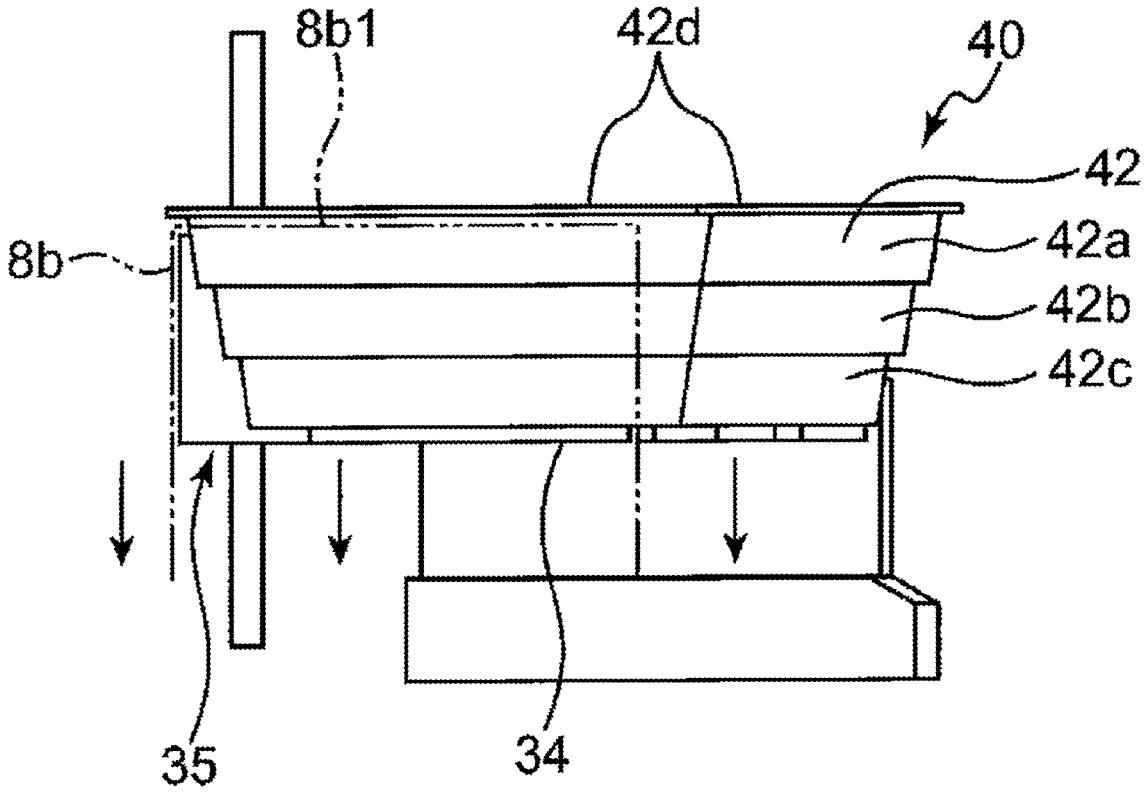
FIG. 24 is perspective explanatory diagram illustrating a state where the storage box in FIG. 23 is being extended as banknotes are stacked.

As illustrated in FIGS. 22 to 23, when the storage box 40 is set in the box storage space 7*a*, the folded storage box 40 is inserted into the box storage space 7*a*, and the upper end of the side wall 42 of the storage box 40 is supported at the predetermined height by the upper end faces 8*b*1 of the guide plates 8*b*. At this time, both sides of the side wall 42 of the storage box 40 are respectively in a state of being caught and suspended by the upper end faces 8*b*1 of the guide plates 8*b*. Further, the bottom wall 41 is arranged at a predetermined upper position by the support arm 34 of the moving member 35 of the table moving unit 11, or by the own elastic force of the side wall 42. Accordingly, the storage box 40 in the folded state can be attached to the upper position in the box storage space 7*a*. As a result, when a plurality of banknotes are loaded into the storage box 40 from the opening in the upper part of the storage box 40, the banknotes are hardly scattered, and can be stacked in a state where the ends thereof are aligned more tidily. Further, as illustrated in FIG. 24, as the banknotes are stacked inside the storage box 40, the bottom wall 41 descends due to the own weight of the banknotes or a driving force of the table moving unit 11, thereby enabling to stack the banknotes in the storage box 40 in a state where the respective ends are aligned more tidily, while the side wall 42 is vertically extended to cover the circumference of the banknotes.

The storage box 40 in a state of being vertically extended with banknotes being stacked therein is taken out from the box storage space 7*a* as it is and stored in a state where the upper end opening is closed. Alternatively, the storage box 40 can be stored in a state of being suspended from a storage shelf having a portion to which the flange 42*d* at the upper end of the side wall 42 can be hooked. When an unmanned operation for storing and taking out the storage box 40 in or from the storage shelf is performed by using a robot or the like, the storage box 40 does not need to be closed by a lid, thereby enabling to improve the efficiency of work such as transport and storage of the storage box 40.

When the banknotes stored in the storage box 40 are to be taken out, if the storage box 40 is placed on a flat surface such as a workbench, the side wall 42 is folded by its own weight to expose the banknotes inside the storage box 40 to outside, and thus the banknotes can be easily taken out. Particularly, when the bottom wall 41 is detachable from the side wall 42, if the storage box 40 is placed on a pedestal having an upper face having the same or smaller area than the area of the bottom wall 41, the side wall 42 is separated from the bottom wall 41 and drops below the bottom wall 41 to expose the banknotes to outside on the pedestal in a state of being placed on the bottom wall 41, thereby facilitating the operation to take out the banknotes.

Further, if the empty storage box 40 in which no banknote is stored is in a folded state, storage and transport thereof are easy.

The paper sheets to be processed by the paper sheet processing device of the present invention are subjected to a plurality of processing of paper sheets (such as discrimination of authenticity and denomination), and a plurality of processed paper sheets are stacked. Therefore, paper sheets referred to in the present invention include not only the banknotes illustrated in the embodiments described above, but also checks, virtual banknotes for games used in a game hall, and the like.

REFERENCE SIGNS LIST

1 banknote processing device
4 processing unit
6 stacking unit
7 stacking unit main body
7*a* box storage space
9,40 storage box
9*a*,41 bottom wall
9*b*,42 side wall
9*c* banknote storage space
9*d* opening
9*e* slit for magnet coupling
9*f* bottom opening
9*i* first slit for allowing passage of the support arm
9*h* second slit for allowing passage of the operation portion
10 stacking table (placing portion)
11 table moving unit (placing-portion moving unit)
15 magnet on the side of the banknote stacking table
21 linear bush (moving member)
23 drive mechanism
29 extension coil spring (energizing member)
30 magnet on the side of the linear bush
34 support arm (support portion)
35 moving member
P banknote
PA stacked banknotes

The invention claimed is:

1. A paper sheet processing device that processes a plurality of paper sheets and stacks the processed paper sheets, the paper sheet processing device comprising:

a processing unit that processes the paper sheets; and at least one stacking unit that stacks therein the paper sheets after being processed by the processing unit, wherein the stacking unit includes a stacking unit main body having a box storage space, a storage box having a size capable of putting in and out the storage box from the box storage space, and having an opening formed in an upper part of the storage box, through which the paper sheets can pass, and a paper-sheet storage space for storing the stacked paper sheets, a placing portion having an upper surface that is wide enough to place the paper sheets thereon and arranged movably in a vertical direction inside the storage box, and a placing-portion moving unit that moves the placing portion at least upward, in a state where the storage box is stored in the box storage space, wherein the placing-portion moving unit has a moving member capable of moving vertically, and the placing portion can be attached to or detached from the moving member, wherein the paper sheet processing device further comprises a coupling unit that detachably couples the placing portion and the moving member with each other, wherein the coupling unit includes at least one magnet, and the magnet is provided in any one or both of the placing portion and the moving member, and the magnet is arranged to detachably couple the placing portion and the moving member with each other in a state where the storage box is stored in the box storage space, and release the coupling in a state where the storage box is out of the box storage space.

2. The paper sheet processing device according to claim 1, wherein a slit for magnet coupling, which penetrates a side wall and extends vertically, is formed in the side wall of the storage box, and the magnet couples the placing portion and the moving member with each other through the slit.

3. A paper sheet processing device that processes a plurality of paper sheets and stacks the processed paper sheets, the paper sheet processing device comprising:

a processing unit that processes the paper sheets; and at least one stacking unit that stacks therein the paper sheets after being processed by the processing unit, wherein the stacking unit includes a stacking unit main body having a box storage space, a storage box having a size capable of putting in and out the storage box from the box storage space, and having an opening formed in an upper part of the storage box, through which the paper sheets can pass, and a paper-sheet storage space for storing the stacked paper sheets, a placing portion having an upper surface that is wide enough to place the paper sheets thereon and arranged movably in a vertical direction inside the storage box, and a placing-portion moving unit that moves the placing portion at least upward, in a state where the storage box is stored in the box storage space wherein the placing-portion moving unit has a moving member capable of moving vertically, and the placing portion can be attached to or detached from the moving member, wherein the paper sheet processing device further comprises a coupling unit that detachably couples the placing portion and the moving member with each other, the moving member includes a support portion having a shape capable of supporting the placing portion from below in a state capable of being detached from the placing portion, the storage box has a bottom wall and a side wall standing upward from an edge of the bottom wall, the side wall has a first slit for passage of the support portion, which penetrates the side wall and extends vertically, through which the support portion can pass, and the bottom wall has a bottom opening communicating with the first slit, through which the support portion can pass, the side wall has a second slit communicating with the bottom opening and penetrating the side wall; and the support portion can be operated downward by projecting to outside of the storage box through the second slit, in a state where the support portion is inserted into the storage box.

* * * * *